US012264006B1

(12) United States Patent
Ott et al.

(10) Patent No.: US 12,264,006 B1
(45) Date of Patent: Apr. 1, 2025

(54) INSULATED PACKAGING LINER

(71) Applicant: Pratt Corrugated Holdings, Inc., Brookhaven, GA (US)

(72) Inventors: Paul Ott, Atlanta, GA (US); Greg Sollie, Sharpsburg, GA (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 0 days.

(21) Appl. No.: 18/393,116

(22) Filed: Dec. 21, 2023

(51) Int. Cl.
*B65D 81/38* (2006.01)
*B65D 5/20* (2006.01)
*B65D 5/42* (2006.01)

(52) U.S. Cl.
CPC ..... *B65D 81/3823* (2013.01); *B65D 5/2033* (2013.01); *B65D 5/4266* (2013.01); *B65D 2571/0066* (2013.01)

(58) Field of Classification Search
CPC ..... B65D 81/3832; B65D 81/3825; B65D 5/2033; B65D 5/4266; B65D 5/5045; B65D 2571/0066; B65D 5/505; B65D 5/5028; B65D 5/5035; B65D 5/503
USPC ..... 206/521–594
See application file for complete search history.

(56) References Cited

U.S. PATENT DOCUMENTS 736,955 A 8/1903 Garman
975,121 A * 11/1910 Carter ..... B65D 5/5016 206/521
1,691,736 A 11/1928 Oppenheim
1,795,613 A 3/1931 Moehle
1,813,787 A * 7/1931 Webster ..... B65D 81/3853 220/592.23
2,031,254 A 2/1936 Derr
2,173,871 A 9/1939 Zalkind
2,231,982 A 2/1941 Zalkind
2,260,181 A 10/1941 Hollingsworth
2,326,817 A * 8/1943 Zalkind ..... B65D 81/3853 229/167
2,332,287 A 10/1943 Zalkind
2,496,731 A 2/1950 Longo
2,553,418 A * 5/1951 Loth ..... B65D 5/5071 206/583
2,735,607 A 2/1956 Wasyluka
(Continued)

FOREIGN PATENT DOCUMENTS

DE 202015002945 4/2016
EP 3398877 11/2018
(Continued)

OTHER PUBLICATIONS

Marsh, et al.; Article entitled: "Food Packaging—Roles, Materials, and Environmental Issues", Journal of Food Science 72.3 (2008): R39-R55, 17 pgs.

(Continued)

*Primary Examiner* — Chun Hoi Cheung
(74) *Attorney, Agent, or Firm* — Taylor English Duma LLP

(57) ABSTRACT

An insulated packaging assembly can include a box and a liner including a plurality of sides and a bottom and arranged within the box, the liner including at least one separation feature connected to at least one side of the liner, wherein each separation feature is arranged between one side of the liner and the box such that the side of the liner is arranged an insulation distance from the box.

19 Claims, 18 Drawing Sheets

(56) References Cited

U.S. PATENT DOCUMENTS 2,808,977 A * 10/1957 McCormick ..... B65D 5/58 206/521
2,927,720 A 3/1960 Adams
3,075,683 A * 1/1963 Grossman ..... B65D 5/5045 206/521
3,245,602 A * 10/1966 Bovard ..... B65D 5/5045 206/521
3,279,677 A * 10/1966 Wojcik ..... B65D 5/58 206/521
3,883,065 A * 5/1975 Presnick ..... B65D 5/58 220/666
3,982,682 A 9/1976 Tremion
D247,952 S 5/1978 Donaldson
4,171,745 A * 10/1979 Zicko ..... B65D 5/505 229/120.28
4,254,173 A 3/1981 Peer, Jr.
4,257,550 A 3/1981 Frohlicher
4,806,398 A 2/1989 Martin, Jr.
4,826,011 A 5/1989 Jud
5,055,161 A 10/1991 Hoffman
5,056,665 A 10/1991 Boecker et al.
5,075,152 A 12/1991 Tsukuda et al.
5,126,519 A 6/1992 Peleg
5,283,118 A 2/1994 Murakami et al.
5,335,846 A * 8/1994 Smith ..... B65D 77/02 229/120.32
5,388,701 A * 2/1995 Ridgeway ..... B65D 81/075 206/583
5,399,366 A 3/1995 Geddes et al.
5,579,917 A * 12/1996 Lofgren ..... B65D 81/075 206/583
5,690,853 A 11/1997 Jackson et al.
5,723,223 A 3/1998 Quick
6,092,654 A * 7/2000 Webb ..... B65D 5/5045 206/319
6,311,843 B1 11/2001 Smith et al.
6,405,873 B2 * 6/2002 Koike ..... B65D 81/025 206/592
D466,409 S 12/2002 Wood
6,513,703 B2 2/2003 Becker
6,517,243 B2 2/2003 Huffer et al.
6,761,793 B2 7/2004 Murano
6,780,269 B2 8/2004 Kobayashi et al.
6,971,539 B1 12/2005 Abbe
7,021,524 B1 4/2006 Becker et al.
7,229,677 B2 6/2007 Miller
7,278,249 B2 * 10/2007 Kari ..... B65D 5/5069 493/137
7,452,316 B2 * 11/2008 Cals ..... B65D 81/127 206/594
7,753,209 B2 7/2010 McDonald et al.
7,935,410 B2 5/2011 Orologio
7,935,411 B2 5/2011 Orologio
8,221,871 B2 7/2012 Orologio
8,327,601 B2 12/2012 Orologio
8,343,614 B2 1/2013 Orologio
8,763,811 B2 * 7/2014 Lantz ..... B65D 65/466 206/584
8,851,362 B2 10/2014 Aksan et al.
8,936,847 B2 1/2015 Orologio
9,015,895 B2 4/2015 Filho et al.
9,114,593 B2 8/2015 Orologio
9,138,968 B2 9/2015 Shi et al.
9,238,523 B1 1/2016 Frost
9,284,088 B2 3/2016 Humphries et al.
9,345,316 B2 5/2016 Filho et al.
9,345,379 B2 5/2016 Filho et al.
9,474,361 B2 10/2016 Filho et al.
9,492,050 B2 11/2016 Filho et al.
9,511,899 B1 12/2016 Valentini et al.
D782,763 S 3/2017 Xavier et al.
D782,764 S 3/2017 Xavier et al.
D790,788 S 6/2017 Xavier et al.
9,682,795 B1 6/2017 Frost
D792,041 S 7/2017 Xavier et al.
D792,762 S 7/2017 Meneaud
D793,229 S 8/2017 Meneaud
9,815,585 B2 11/2017 Gasior et al.
9,888,764 B2 2/2018 Xavier et al.
9,908,663 B1 3/2018 Valentini et al.
9,924,790 B2 3/2018 Xavier et al.
9,932,162 B2 3/2018 Stack, Jr.
9,981,797 B2 5/2018 Aksan et al.
10,035,638 B1 7/2018 Leroy
10,106,290 B2 10/2018 Couture
10,196,170 B2 2/2019 Gasior
10,358,283 B2 7/2019 Lutzig
10,583,977 B2 3/2020 Collison et al.
10,625,488 B2 4/2020 Alef et al.
10,696,450 B2 6/2020 Valentini et al.
10,843,840 B2 * 11/2020 Sollie ..... B65D 25/02
10,870,529 B2 12/2020 Khatchaturian et al.
10,882,682 B2 1/2021 Collison et al.
11,072,148 B2 7/2021 Yializis et al.
11,078,010 B2 8/2021 Bellamah et al.
11,085,688 B2 8/2021 Seo et al.
11,214,427 B2 1/2022 Collison et al.
11,267,645 B2 3/2022 Bellamah et al.
11,312,563 B2 * 4/2022 Smith ..... B65D 81/052
11,338,985 B2 5/2022 Henderson et al.
11,383,878 B2 7/2022 Frost
11,427,391 B2 8/2022 Comerford
11,634,265 B2 4/2023 Collison et al.
D988,862 S 6/2023 Turner
11,780,666 B2 10/2023 Collison et al.
2004/0004111 A1 1/2004 Cardinale
2004/0038050 A1 2/2004 Saijo et al.
2004/0101215 A1 5/2004 Sellmeier et al.
2005/0221104 A1 10/2005 Ortolani et al.
2006/0070699 A1 4/2006 Sparks et al.
2006/0105124 A1 5/2006 Kikuchi
2006/0213803 A1 9/2006 Saitou et al.
2006/0222796 A1 10/2006 Morris
2007/0010386 A1 1/2007 Champ et al.
2007/0110932 A1 5/2007 Castillo et al.
2007/0215681 A1 9/2007 Johnson
2007/0243396 A1 10/2007 Buchbinder et al.
2010/0285266 A1 11/2010 Korte
2011/0048996 A1 3/2011 Klaus et al.
2011/0100868 A1 5/2011 Lantz
2011/0123137 A1 5/2011 Smith et al.
2011/0143070 A1 6/2011 Toft et al.
2011/0192852 A1 8/2011 Chebli
2011/0236664 A1 8/2011 Ortolani et al.
2011/0253773 A1 10/2011 Lozier
2012/0015145 A1 1/2012 Depres
2012/0100320 A1 4/2012 Toft et al.
2012/0106877 A1 5/2012 Tang
2012/0117921 A1 5/2012 Toft et al.
2012/0171453 A1 7/2012 Rochat et al.
2012/0207954 A1 8/2012 Dalpe et al.
2013/0122268 A1 5/2013 Reilly et al.
2015/0158656 A1 6/2015 McKinnon
2016/0376084 A1 12/2016 Wein et al.
2017/0001781 A1 1/2017 Cojocaru et al.
2017/0043565 A1 2/2017 Fushimi et al.
2017/0066582 A1 3/2017 Vogel et al.
2017/0151765 A1 6/2017 Öhman
2017/0166361 A1 6/2017 Shirosawa et al.
2017/0313045 A1 11/2017 Braghini
2018/0022499 A1 1/2018 Sridhar et al.
2018/0148246 A1 5/2018 Fu et al.
2018/0178965 A1 6/2018 Tsai et al.
2018/0290813 A1 10/2018 Waltermire et al.
2018/0298168 A1 10/2018 Nummila-Pakarinen et al.
2018/0311940 A1 11/2018 Toft et al.
2018/0327171 A1 11/2018 Waltermire et al.
2019/0126599 A1 5/2019 Sargeant et al.
2019/0210324 A1 7/2019 Yializis et al.
2019/0315553 A1 10/2019 Fiflis et al.
2019/0359407 A1 11/2019 Kale et al.
2020/0115135 A1 4/2020 Li et al.
2020/0148453 A1 5/2020 Sollie et al.

(56) References Cited

U.S. PATENT DOCUMENTS

| | | | |
|---|---|---|---|
| 2020/0262636 | A1 | 8/2020 | Wiemann et al. |
| 2021/0130075 | A1 | 5/2021 | Long |
| 2021/0139200 | A1 | 5/2021 | O'Hara et al. |
| 2021/0347553 | A1 | 11/2021 | Sollie et al. |
| 2021/0371152 | A1 | 12/2021 | Crespo |
| 2022/0002070 | A1 | 1/2022 | Moghaddas et al. |
| 2022/0119149 | A1 | 4/2022 | Comerford |
| 2022/0169435 | A1 | 6/2022 | Wiemann et al. |
| 2022/0194678 | A1 | 6/2022 | Kilmer |
| 2022/0250827 | A1 | 8/2022 | Smith |
| 2022/0289450 | A1 | 9/2022 | Bollinger et al. |
| 2022/0388759 | A1 | 12/2022 | Patel et al. |
| 2023/0079525 | A1 | 3/2023 | Tuano et al. |
| 2024/0140643 | A1 | 5/2024 | Takahashi |
| 2024/0253848 | A1 | 8/2024 | Sollie et al. |
| 2024/0253849 | A1 | 8/2024 | Sollie et al. |
| 2024/0253853 | A1 | 8/2024 | Sollie et al. |
| 2024/0253854 | A1 | 8/2024 | Sollie et al. |
| 2024/0317481 | A1 | 9/2024 | Sollie et al. |

FOREIGN PATENT DOCUMENTS

| | | |
|---|---|---|
| FR | 2656591 | 7/1991 |
| GB | 2218406 | 11/1989 |
| GB | 2540389 | 1/2017 |
| KR | 20210089477 | 7/2021 |
| WO | 2014006279 | 1/2014 |
| WO | 2014071377 | 5/2014 |
| WO | 2018220132 | 12/2018 |

OTHER PUBLICATIONS

Rahman, et al.; Handbook of Food Preservation, Second Edition, Springer, London, 2012. pp. 211-250, 1088 pgs.
Risch, Sara J.; Article entitled: "Food Packaging History and Innovations", Journal of Agricultural and Food Chemistry 57.18 (2009), 8089-8092, 4 pgs.
Verghese, et al.; "Packaging for Sustainability", Springer, London, 2012. 211-250, 389 pgs.
Custom Packaging Co., Ltd; Article entitled: "Cardboard Insulated Boxes", located at <https://www.boxpackingsolution.com/insulated-boxes/>, Copyright 1998-2023, 9 pgs.
Nice Packs; Article entitled: "Insulated Shipping Boxes", located at <https://www.shopnicepacks.com/products/insulated-shipping-box>, Copyright 2023, 17 pgs.
Sorbafreeze; Article entitled: "Chilltek Ecotek Box", located at <https://www.sorbafreeze.com/product/ecotek-insulated-corrugated-box/>, Copyright 2023, 7 pgs.
Starlight Packaging; Article entitled: "Environmentally Friendly Insulated Cool Box", located at <https://starlightpackaging.co.uk/boxes/environmentally-friendly-insulated-cool-box/>, Copyright 2023, 7 pgs.
The Print Daddy; Article entitled: "Cardboard Box Dividers and Partitions", located at <https://theprintingdaddy.com/cardboard-box-dividers-and-partitions>, Copyright 2021, 6 pgs.
Sollie, Greg; Non-Final Office Action for U.S. Appl. No. 18/425,552, filed Jan. 29, 2024, mailed Aug. 22, 2024, 36 pgs.
Sollie, Greg; Non-Final Office Action for U.S. Appl. No. 18/386,187, filed Nov. 1, 2023, mailed Oct. 1, 2024, 31 pgs.
Sollie, Greg; Requirement for Restriction/Election for U.S. Appl. No. 18/386,187, filed Nov. 1, 2023, mailed Aug. 12, 2024, 9 pgs.
Sollie, Greg; Non-Final Office Action for U.S. Appl. No. 18/222,272, filed Jul. 14, 2023, mailed Aug. 22, 2024, 55 pgs.
Sollie, Greg; Non-Final Office Action for U.S. Appl. No. 18/222,284, filed Jul. 14, 2023, mailed Aug. 29, 2024, 31 pgs.
Sollie, Greg; Non-Final Office Action for U.S. Appl. No. 18/222,293, filed Jul. 14, 2023, mailed Oct. 11, 2024, 36 pgs.
Sollie, Greg; Requirement for Restriction/Election for U.S. Appl. No. 18/222,293, filed Jul. 14, 2023, mailed Jul. 26, 2024, 6 pgs.
Sollie, Greg; Non-Final Office Action for U.S. Appl. No. 18/222,298, filed Jul. 14, 2023, mailed Aug. 15, 2024, 31 pgs.
Jones Family of Companies I Cold Chain Packaging; "Jones Sustainable Packaging". Date first available: May 29, 2023. Site visited: Jul. 29, 2024. Available online: https://jonesfamilyco.com/cold-chain-packaging (Year: 2023), 3 pgs.
Ott, Paul; Applicant-Initiated Interview Summary for Design U.S. Appl. No. 29/923,155, filed Dec. 28, 2023, mailed Oct. 2, 2024, 3 pgs.
Ott, Paul; Non-Final Office Action for Design U.S. Appl. No. 29/923,155, filed Dec. 28, 2023, mailed Aug. 16, 2024, 26 pgs.
Supplyone Sunrise; Large Styrofoam Cooler I MrBoxOnline. Date first available: Sep. 27, 2013. Site visited: Jul. 29, 2024. Available online: https://www.mrboxonline.com/15375x95x105-quart-large-styrofoam-coolers-p-2118.html (Year: 2013), 4 pg.
Uline; Insulated Box Liners—12×12×6" S-18278. Date first available: Mar. 20, 2015. Site visited: Jul. 29, 2024. Available online: https://www.uline.com/ProducUDetail/S-18278/Insulated-Shippers-and-Supplies/Insulated-Box-Liners-12-x-12-x-6 (Year: 2015), 1 pg.
Sollie, Greg; Final Office Action for U.S. Appl. No. 18/425,552, filed Jan. 29, 2024, mailed Dec. 13, 2024, 22 pgs.
Sollie, Greg; Final Office Action for U.S. Appl. No. 18/222,272, filed Jul. 14, 2023, mailed Dec. 20, 2024, 47 pgs.
Sollie, Greg; Notice of Allowance for U.S. Appl. No. 18/222,284, filed Jul. 14, 2023, mailed Nov. 4, 2024, 14 pgs.
Sollie, Greg; Notice of Allowance for U.S. Appl. No. 18/222,293, filed Jul. 14, 2023, mailed Dec. 19, 2024, 5 pgs.
Sollie, Greg; Final Office Action for U.S. Appl. No. 18/222,298, filed Jul. 14, 2023, mailed Jan. 2, 2025, 24 pgs.
Ott, Paul; Final Office Action for Design U.S. Appl. No. 29/923,155, filed Dec. 28, 2023, mailed Dec. 4, 2024, 20 pgs.
Sollie, Greg; Final Office Action for U.S. Appl. No. 18/386,187, filed Nov. 1, 2023, mailed Jan. 24, 2025, 20 pgs.

* cited by examiner

INSULATED PACKAGING LINER

REFERENCE TO RELATED APPLICATIONS

This application references U.S. patent application Ser. No. 18/222,272, filed Jul. 14, 2023, which claims the benefit of U.S. Provisional Application No. 63/441,946, filed Jan. 30, 2023, U.S. Provisional Application No. 63/447,380, filed Feb. 22, 2023, and U.S. Provisional Application No. 63/466,836, filed May 16, 2023, each of which is hereby specifically incorporated by reference herein in its entirety. This application also references U.S. patent application Ser. No. 17/834,999, filed Jun. 8, 2022, (issued as U.S. Pat. No. 11,780,666 on Oct. 10, 2023), which is a continuation application of U.S. patent application Ser. No. 17/502,599, filed Oct. 15, 2021 (issued as U.S. Pat. No. 11,634,265 on Apr. 25, 2023), which is a continuation of U.S. patent application Ser. No. 17/123,673, filed Dec. 16, 2020 (issued as U.S. Pat. No. 11,214,427 on Jan. 4, 2022), which is a continuation application of U.S. patent application Ser. No. 16/414,309, filed May 16, 2019 (issued as U.S. Pat. No. 10,882,682 on Jan. 5, 2021), which is a divisional application of U.S. patent application Ser. No. 15/677,738, filed Aug. 15, 2017 (issued as U.S. Pat. No. 10,583,977 on Mar. 10, 2020), which claims the benefit of U.S. Provisional Application No. 62/375,555, filed on Aug. 16, 2016, U.S. Provisional Application No. 62/419,894, filed on Nov. 9, 2016, and U.S. Provisional Application No. 62/437,365, filed on Dec. 21, 2016. The entire disclosure of each of the above applications is incorporated herein by reference in its entirety.

TECHNICAL FIELD

This disclosure relates to packaging. More specifically, this disclosure relates to insulated packaging.

BACKGROUND

Packaging can have a variety of arrangements and uses. In various aspects, packaging can be designed for insulation purposes. In various aspects of packaging, it can be difficult to thermally insulate the contents of a packaging element. In packaging elements where insulation is included, costs of producing packaging can be high, and the number of parts utilized can also be high. In various packaging elements, insulated packaging can be unrecyclable.

SUMMARY

Disclosed is an insulated packaging assembly including a box, the box having a plurality of sides and a bottom, the box defining an opening at a top end; a liner, the liner comprising a plurality of sides, each side of the liner corresponding to one side of the box such that the box and the liner comprise the same number of sides; a bottom; and at least one separation feature connected to each side of the liner, wherein each separation feature is arranged between the side of the liner and the corresponding side of the box such that the side of the liner is arranged an insulation distance from the corresponding side of the box; and a liner top, the liner top being in contact with each of the plurality of sides of the liner.

Also disclosed is a blank for forming the liner. Also disclosed is a blank for forming the liner top.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is an insulated packaging assembly and associated methods, systems, devices, and various apparatus. The insulated packaging assembly can include a liner formed from a liner blank, a top formed from a blank, and a box. It would be understood by one of skill in the art that the disclosed insulated packaging assembly is described in but a few exemplary embodiments among many. No particular terminology or description should be considered limiting on the disclosure or the scope of any claims issuing therefrom.

Figure 1:
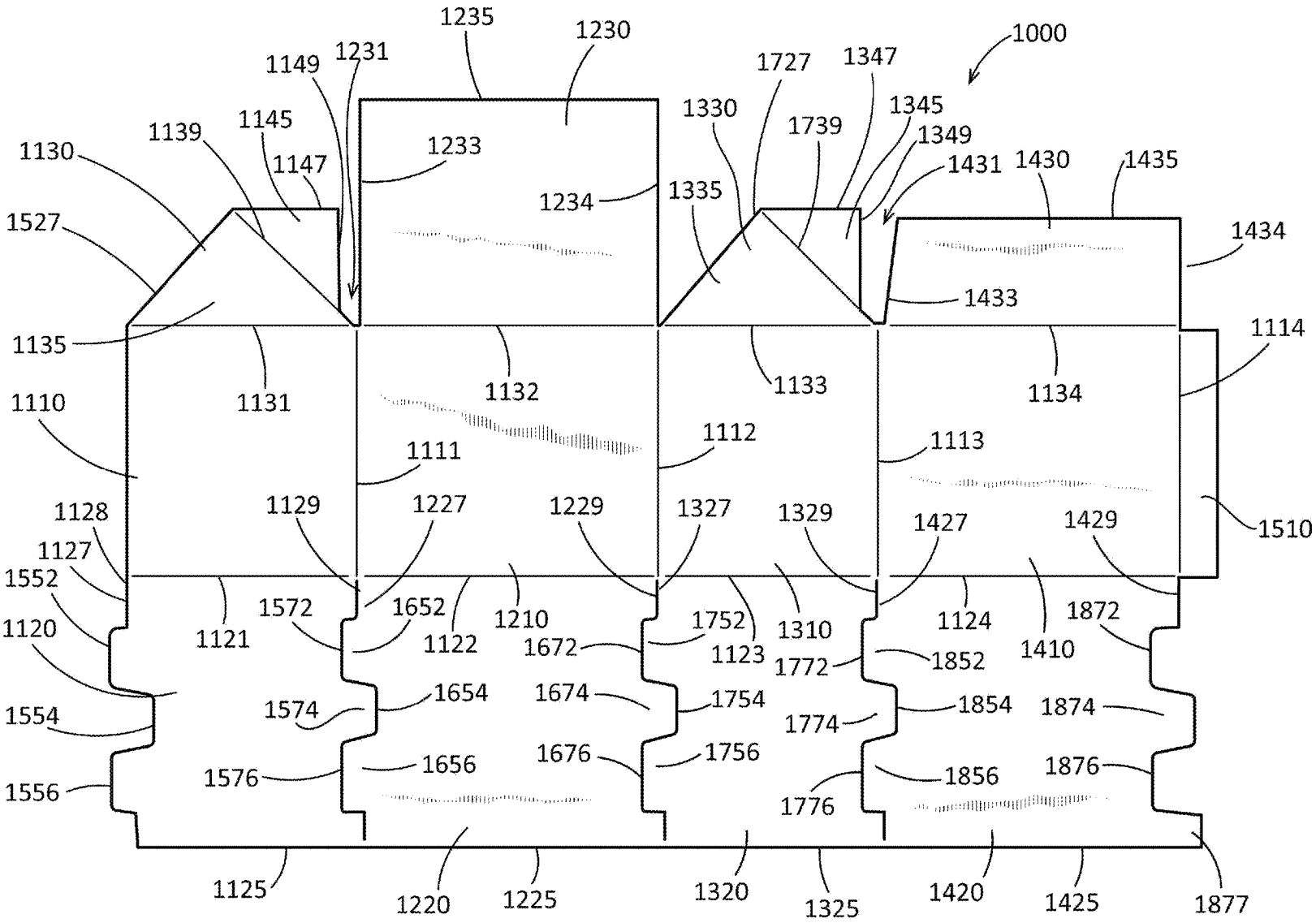
FIG. 1 is a plan view of a liner blank for forming a liner in accord with one aspect of the current disclosure.

One embodiment of a liner blank 1000 for an insulative liner can be seen with reference to FIG. 1. The liner blank 1000 can define a plurality of panels to be formed into a liner. One of skill in the art would understand that the disclosed and described arrangements and methods are but mere examples of the varying ways of making and using the various aspects of the disclosure. No single configuration should be considered limiting on the scope of the disclosure.

The liner blank 1000 can comprise a plurality of lines between elements. In various aspects, the current disclosure references "lines." In various aspects, a "line" or a plurality of "lines" can refer to perforations, cuts, creases, or combinations of cuts, perforations, and creases. In various aspects, perforations can be ⅜ inches; in various aspects, perforations can be ¼ inches; in various aspects, cuts can be ½ inches; in various aspects, perforations and cuts can be of variant sizes. If not specified in the disclosure, one of skill in the art would understand that various lines described herein can be interchangeable between various aspects of the current disclosure, and one of skill in the art would not understand any particular embodiment of "line" or "lines" to be limiting on the scope of the disclosure.

The liner blank 1000 in the current aspect can comprise a first central panel 1110, a second central panel 1210, a third central panel 1310, and a fourth central panel 1410. In the current aspect, the first central panel 1110 can be connected to the second central panel 1210 by a line 1111; the second central panel 1210 can be connected to the third central panel by a line 1112; and the third central panel 1310 can be connected to the fourth central panel 1114 by a line 1113. A connection panel 1510 can be connected to the fourth central panel 1410 by a line 1114.

Each central panel 1110,1210,1310,1410 can be connected to at least one other panel. The first central panel 1110 can be connected to a first end panel 1120 by a line 1121. The second central panel 1210 can be connected to a second end panel 1220 by a line 1122. The third central panel 1310 can be connected to a third end panel 1320 by a line 1123. The fourth central panel 1410 can be connected to a fourth end panel 1420 by a line 1124. Each end panel 1120,1220,1320, 1420 can define a panel end 1125,1225,1325,1425, respectively. In various aspects, each panel end 1125,1225,1325, 1425 can be aligned such that the panel ends 1125,1225, 1325,1425 arranged next to one another forms a single line. In various aspects, such alignment can be termed "coincident" if the panel ends together form one line that can serve as an end of the liner blank 1000.

Central panel 1110 can be connected to a fold panel 1130 by a line 1131. Central panel 1310 can be connected to a fold panel 1330 by a line 1133. Central panel 1210 can be connected to a bottom panel 1230 by a line 1132. Central panel 1410 can be connected to an intermediary panel 1430 by a line 1134.

Each end panel 1120,1220,1320,1420 can comprise features to define a spacer-like element when the liner blank 1000 is assembled, as will be discussed later. The first end panel 1120 can comprise a plurality of tabs and dips. A lateral end 1127 of the first end panel 1120 can define various features. For reference, a base 1128 can be defined as a place where the lateral end 1127 starts by the line 1121. As such, protrusions and recessions can be measured with respect to the base 1128. A first protrusion tab 1552 can extend laterally from the base 1128 of the first end panel 1120. Corners of the protrusion tab 1552 can be filleted as seen in the current view; however, corners need not be filleted in all aspects. Immediately adjacent the first protrusion tab 1552 can be arranged a recession 1554 as defined from the reference of the base 1128. The recession 1554 can be arranged immediately adjacent to the first protrusion tab 1552 to magnify the distance between an end of the first protrusion tab 1552 and an end of the recession 1554. Corners of the recession 1554 can be filleted as seen in the current view; however, corners need not be filleted in all aspects. Immediately adjacent to the defined recession 1554 can be a second protrusion tab 1556. The second protrusion 1556 can be substantially similar in shape and arrangement to the first protrusion tab 1554. The second protrusion tab 1556 can be arranged adjacent to the recession 1554 such that the recession 1554 can be arranged between the first protrusion tab 1552 and the second protrusion tab 1556. Corners of the protrusion 1556 can be filleted as seen in the current view; however, corners need not be filleted in all aspects.

Similar patterns can exist elsewhere at the junctions of the end panels 1120,1220,1320,1420. An end 1129 of the first end panel 1120 can be coincident with an end 1227 of the second end panel 1220. The end 1227 of the second end panel 1220 can be similar in profile to the end 1127 of the first end panel 1120. A first protrusion tab 1652 can be about the same size and shape as the first protrusion tab 1552. A second protrusion tab 1656 can be about the same size and shape as the second protrusion tab 1556. A recession 1654 can be defined of about the same size and shape as the recession 1554. The features of the end 1227 can be of mating arrangement with the features of the end 1129 such that the features of the end 1129 can be a mirror or inverse of the end 1227. The end 1129 can define a first recession 1572. Immediately adjacent the first recession 1572 can be a protrusion tab 1574. A second recession 1576 can be defined in the end 1129 immediately adjacent to the protrusion tab 1574. The ends 1129,1227 can extend a small portion beyond the protrusion and recession features 1572, 1574,1576,1652,1654,1656 before terminating at each end 1125,1225 of each end panel 1120,1220, respectively.

An end 1229 of the second end panel 1220 can be coincident with an end 1327 of the third end panel 1320. The end 1327 of the third end panel 1320 can be similar in profile to the end 1127 of the first end panel 1120 and the end 1227 of the second end panel 1220. A first protrusion tab 1752 can be about the same size and shape as the first protrusion tab 1552 and the first protrusion tab 1652. A second protrusion tab 1756 can be about the same size and shape as the second protrusion tab 1556 and the second protrusion tab 1656. A recession 1754 can be defined of about the same size and shape as the recession 1554 and the recession 1654. The features of the end 1327 can be of mating arrangement with the features of the end 1229 such that the features of the end 1229 can be a mirror or inverse of the end 1327. Features of the end 1229 can be substantially similar to features of the end 1129. The end 1229 can define a first recession 1672 substantially similar to the first recession 1572. Immediately adjacent the first recession 1672 can be a protrusion tab 1674 substantially similar to protrusion tab 1574. A second recession 1676 can be defined in the end 1229 immediately adjacent to the protrusion tab 1674 and substantially similar to the second recession 1576. The ends 1229,1327 can extend a small portion beyond the protrusion and recession features 1672,1674,1676,1752,1754,1756 before terminating at each end 1225,1325 of each end panel 1220,1320, respectively. In the current aspect, the second end panel 1220 can remain connected to the third end panel 1320 between the termination of second recession 1676 (which is also the termination of the second protrusion 1756) and the panel ends 1225,1325. As such, the portion of ends 1229, 1327 in that location can be a bend line instead of a cut in the current aspect. In various aspects, portions of ends 1229,1327 that are not contained within protrusion and recession features 1672,1674,1676,1752,1754,1756 can remain connected such that ends 1229,1327 can remain as bend lines outside of the protrusion and recession features 1672,1674,1676,1752,1754,1756.

An end 1329 of the third end panel 1320 can be coincident with an end 1427 of the fourth end panel 1420. The end 1427 of the fourth end panel 1420 can be similar in profile to the ends 1127,1227,1327. A first protrusion tab 1852 can be about the same size and shape as each first protrusion tab 1552,1652,1752. A second protrusion tab 1856 can be about the same size and shape as each second protrusion tab 1556,1656,1756. A recession 1854 can be defined of about the same size and shape as each recession 1554,1654,1754. The features of the end 1427 can be of mating arrangement with the features of the end 1329 such that the features of the end 1329 can be a mirror or inverse of the end 1427. Features of the end 1329 can be substantially similar to features of each end 1129,1229. The end 1329 can define a first recession 1772 substantially similar to each first recession 1572,1672. Immediately adjacent the first recession 1772 can be a protrusion tab 1774 substantially similar to each protrusion tab 1574,1674. A second recession 1776 can be defined in the end 1329 immediately adjacent to the protrusion tab 1774 and substantially similar to each second recession 1576,1676. The ends 1329,1427 can extend a small portion beyond the protrusion and recession features 1772,1774,1776,1852,1854,1856 before terminating at each end 1325,1425 of each end panel 1320,1420, respectively.

An end 1429 of the fourth end panel 1420 can be seen as an end of the panel 1420 and representing an end of the liner blank 1000. Features of the end 1429 can be substantially similar to features of each end 1129,1229,1339. The end 1429 can define a first recession 1872 substantially similar to each first recession 1572,1672,1772. Immediately adjacent the first recession 1872 can be a protrusion tab 1874 substantially similar to each protrusion tab 1574,1674,1774. A second recession 1876 can be defined in the end 1429 immediately adjacent to the protrusion tab 1874 and substantially similar to each second recession 1576,1676,176. The end 1429 can extend a small portion beyond the protrusion and recession features 1872,1874,1876 before terminating at the end 1425 of the fourth end panel 1420. In the current aspect, a connection protrusion 1877 can extend about the same distance as protrusion tab 1874 and can be utilized as a connector when the liner blank 1000 can be assembled into a packaging element. The connection protrusion 1877 can also extend about the same distance as the connection panel 1510 can extend from the fourth central panel 1410.

In the current aspect, each protrusion tab 1552, 1556, 1574, 1652, 1656, 1674, 1752, 1756, 1774, 1852, 1856, 1874 can be defined by ends 1127, 1129, 1227, 1229, 1327, 1329, 1427, 1429. As such, each protrusion tab 1552, 1556, 1574, 1652, 1656, 1674, 1752, 1756, 1774, 1852, 1856, 1874 can laterally extend one of the ends 1127, 1129, 1227, 1229, 1327, 1329, 1427, 1429. Similarly, each recession 1554, 1572, 1576, 1654, 1672, 1676, 1754, 1772, 1776, 1854, 1872, 1876 can be defined by ends 1127, 1129, 1227, 1229, 1327, 1329, 1427, 1429 such that each recession 1554, 1572, 1576, 1654, 1672, 1676, 1754, 1772, 1776, 1854, 1872, 1876 can laterally contract one of the ends 1127, 1129, 1227, 1229, 1327, 1329, 1427, 1429. In various aspects, each protrusion tab 1574,1674,1774,1874 can be termed an "alternate protrusion tab" to assist in differentiation between first protrusions 1552,1652,1752,1852 and second protrusions 1556,1656,1756,1856. Similarly, each recession 1554, 1654,1754,1854 can be termed "alternate recession" to assist in differentiation between first recession 1572,1672,1772, 1872 and second recession 1576,1676,1776,1876.

In the current aspect, each end panel 1120,1220,1320, 1420 can be separated for each other end panel such that the features of the panels do not connect directly. One of skill in the art would understand that various connections can be made between the end panels 1120,1220,1320,1420 in various aspects within the scope of the current disclosure.

The fold panel 1130 can be of various shapes and sizes in various aspects of the current disclosure. In the current aspect, the fold panel 1130 can be a shape of two triangles connected by a bend line. A main base panel 1135 can comprise a triangular shape defined on one end by the line 1131. The main base panel 1135 can define an end 1527 that can serve as a part of the edge of the liner blank 1000. The main base panel 1135 can further be defined by a line 1139. Together, lines 1131,1139 and end 1527 can define the triangular shape of the main base panel 1135. A connection panel 1145 can be formed of the remainder of the fold panel 1130. In addition to the line 1139, the connection panel 1145 can be bounded by end 1147 and end 1149. It should be noted that end 1149 is displaced from the bottom panel 1230 by a distance such that a gap 1231 can be defined between the fold panel 1130 and the bottom panel 1230.

The fold panel 1330 can be of various shapes and sizes in various aspects of the current disclosure. In the current aspect, the fold panel 1330 can be a shape of two triangles connected by a bend line. A main base panel 1335 can comprise a triangular shape defined on one end by the line 1133. The main base panel 1335 can define an end 1727 that can serve as a part of the edge of the liner blank 1000. The main base panel 1335 can further be defined by a line 1739. Together, lines 1133,1739 and end 1727 can define the triangular shape of the main base panel 1335. A connection panel 1345 can be formed of the remainder of the fold panel 1330. In addition to the line 1739, the connection panel 1345 can be bounded by end 1347 and end 1349. It should be noted that end 1349 is displaced from the intermediary panel 1430 by a distance such that a gap 1431 can be defined between the fold panel 1330 and the intermediary panel 1430.

The bottom panel 1230 can be rectangular in shape and can define a first lateral end 1233, a second lateral end 1234, and a panel end 1235. The intermediary panel 1430 can be mostly rectangular in shape with some slight variation. The intermediary panel 1430 can define a first lateral end 1433, a second lateral end 1434, and a panel end 1435. In the current aspect, the first lateral end 1433 can be angled at a non-right angle with respect to panel end 1435 and line 1134 such that a width of the intermediary panel 1430 can be smaller along the panel end 1435 than along the line 1134. The arrangement of such an angle can allow easier expansion and contraction of the packaging element formed from the liner blank 1000.

In the current aspect, the liner blank 1000 can be formed of various paper product, including paperboard, corrugated cardboard, kraft paper, and various other materials. In various aspects, the liner blank 1000 can be formed of varying materials including various plastics, metals, wood, or various other elements. In various aspects, the liner blank 1000 can be a combination of materials described herein or known within the relevant art. In various aspects, the packaging of the current disclosure can be formed without the use of a blank such as the liner blank 1000. One of skill in the art would understand that liner blank 1000 is but one method of assembling the packaging of the current disclosure.

In the current aspect, a surface of the liner blank 1000 can be covered by a temperature-preserving liner. In various aspects, the temperature-preserving liner can be a product adhered to a surface of the liner blank 1000. In various aspects, the temperature-preserving liner can be a film adhered to the surface of the liner blank 1000. Films can be adhered to the surface of the liner blank 1000 through various methods, including adhesion (such as with glues or chemical adhesives) or by deposition (such as by vapor deposition) among other methods. In various aspects, the film temperature-preserving liner can be a highly reflective coating. Such a highly reflective surface can be of low emissivity, thereby serving as an effective insulating material. Examples of coatings or films that can be used for temperature-preserving liners can be found with reference to United States Patent Application of Sollie, filed Jul. 14, 2023, bearing application Ser. No. 18/222,272, which is incorporated by reference herein in its entirety. In various aspects, the liner blank 1000 can include the temperature-preserving liner on all sides. In various aspects, the liner blank 1000 can include the temperature-preserving liner on only one side to reduce costs.

Figure 2:
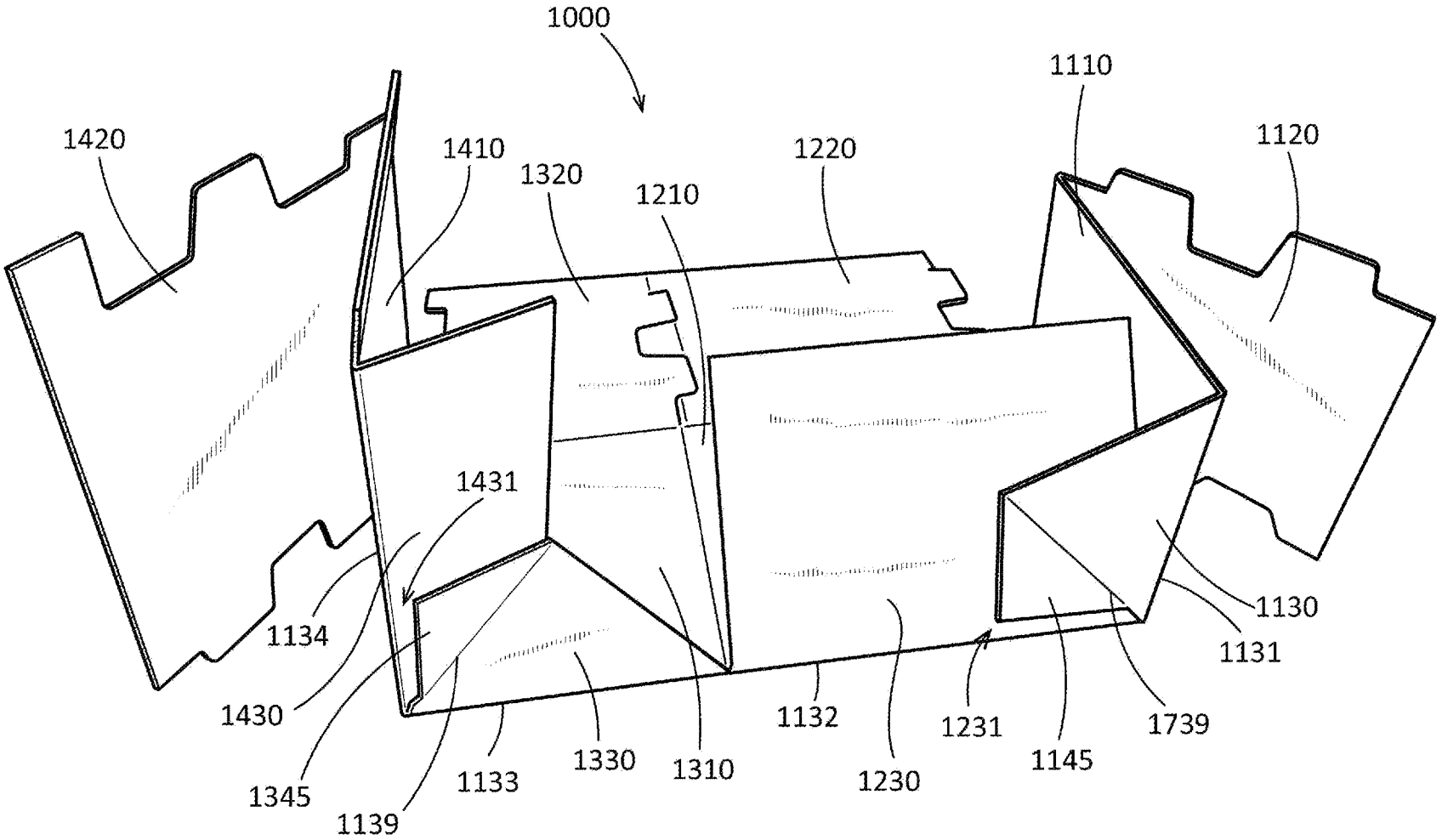
FIG. 2 is a bottom perspective view of the liner blank of FIG. 1 in one step of assembly into the liner.

A process for forming a packaging element from the liner blank 1000 can be seen with beginning reference to FIG. 2. Central panels 1110,1410 can be bent with respect to central panels 1210,1310 along lines 1111,1113 (not shown in the current view), respectively. Bottom panel 1230 can be bent with respect to second central panel 1210 along line 1132. Intermediary panel 1430 can be bent with respect to fourth central panel 1410 along line 1134. Fold panels 1130,1330 can be bent with respect to central panels 1110,1310 along lines 1131,1133, respectively. As such, fold panels 1130, 1330 can be arranged such that connection panel 1145 contacts bottom panel 1230 and connection panel 1345 contacts intermediary panel 1430. In various aspects, connection panel 1145 can be adhered to bottom panel 1230 and connection panel 1345 can be adhered to intermediary panel 1430. In the current aspect, the connection panels 1145,1345 can be adhered while other elements of the fold panels 1130,1330 can be left unadhered. In various aspects, various arrangements can be made. Gaps 1231,1431 that were referenced in the view of FIG. 1 can be seen as space between the connection panels 1145,1345 and lines 1132, 1134, respectively.

Figure 3:
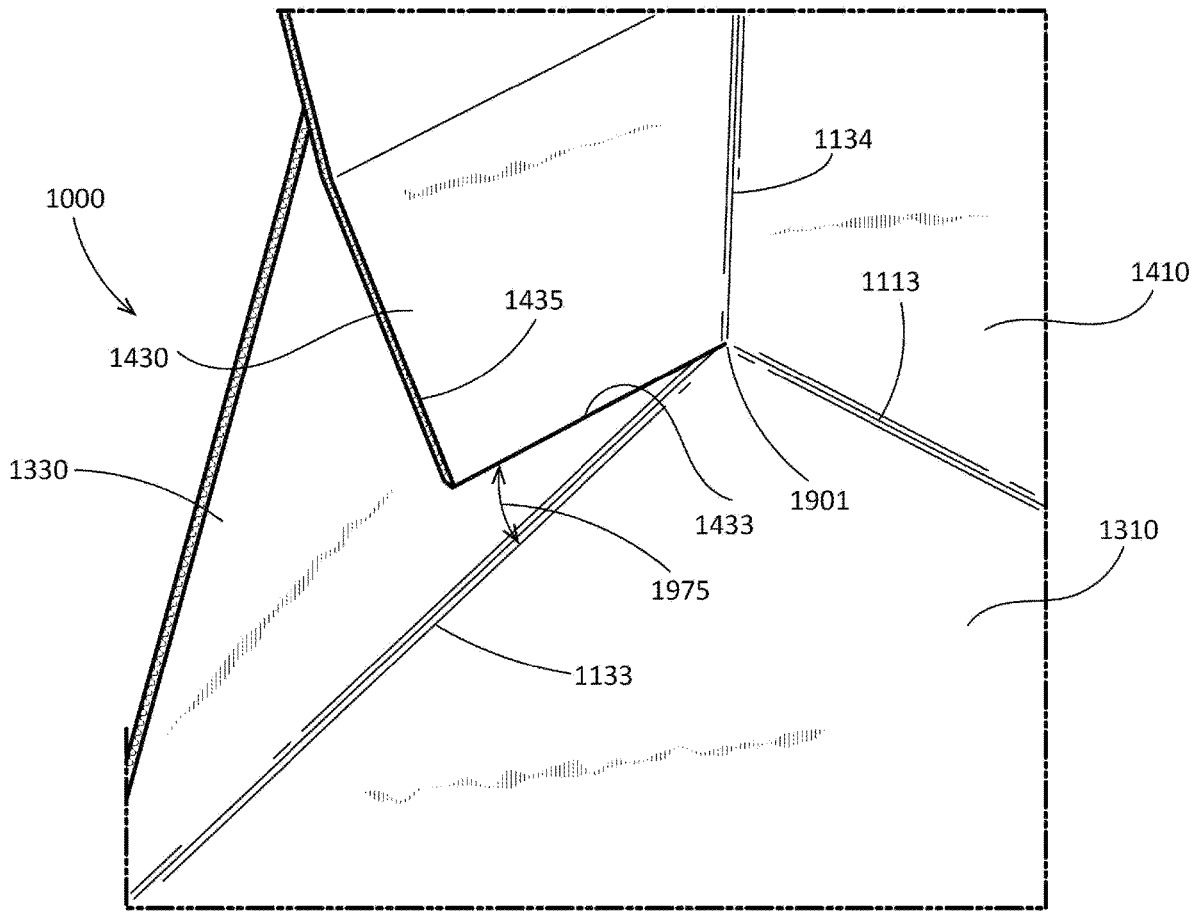
FIG. 3 is a detail perspective view of the liner blank in the assembly step of FIG. 2.

As seen with reference to FIG. 3, a corner 1901 can be seen where fold panel 1330 overlaps intermediary panel 1430 at the junction of central panels 1310,1410. An angle 1975 can be defined by the shape of the intermediary panel 1430. As previously described, the intermediary panel 1430 can be shaped such that the panel end 1435 is of a smaller dimension than the line 1134. Such a shape can produce the angle 1975 which can allow clearance for folding, as will be discussed in greater detail further in this disclosure.

Figure 4:
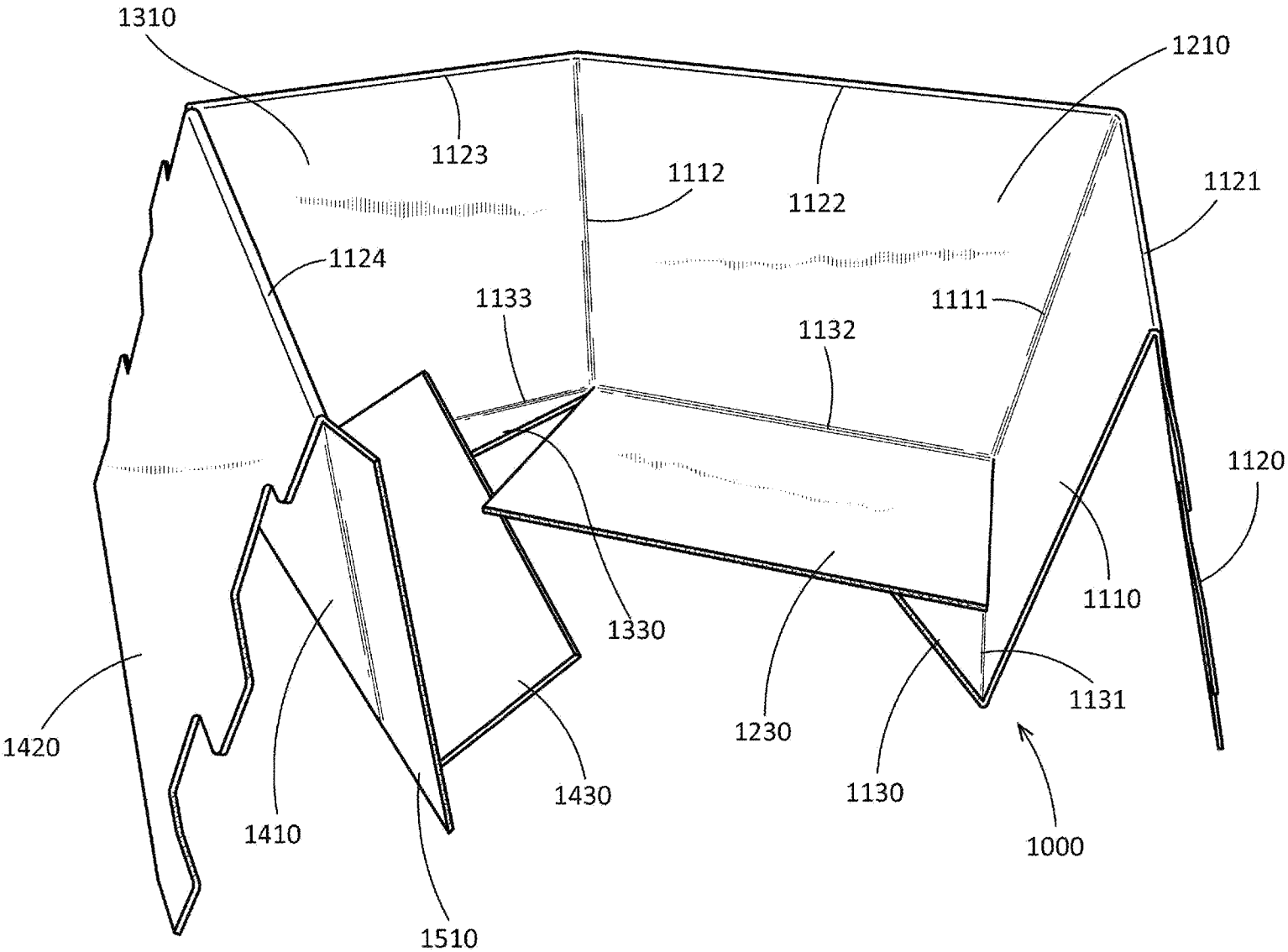
FIG. 4 is a side perspective view of the liner blank of FIG. 1 in another step of assembly into the liner.

Further assembly from the liner blank 1000 can be seen with reference to FIG. 4. In the current view, the various panels can be seen to have been arranged with bends along all lines. The first end panel 1120 can be bent with respect to first central panel 1110 along line 1121 such that one surface of the first end panel 1120 can be contacting one surface of the first central panel 1110. The second end panel 1220 (not shown in the current view) can be bent with respect to second central panel 1210 along line 1122 such that one surface of the second end panel 1220 can be contacting one surface of the second central panel 1210. The third end panel 1320 (not shown in the current view) can be bent with respect to third central panel 1310 along line 1123 such that one surface of the third end panel 1320 can be contacting one surface of the third central panel 1310. The fourth end panel 1420 can be bent with respect to fourth central panel 1410 along line 1124 such that one surface of the fourth end panel 1420 can be contacting one surface of the fourth central panel 1410. In various aspects, the "contacting" referenced herein can be termed as "facing" arrangement, which can mean that surfaces of the various panels are in contact for most of their respective surface areas. Fold panel 1130 can be bent with respect to first central panel 1110 along line 1131. Bottom panel 1230 can be bent with respect to second central panel 1210 along line 1132. Fold panel 1330 can be bent with respect to third central panel 1310 along line 1133. Intermediary panel 1430 can be bent with respect to fourth central panel 1410 along line 1134 (not shown in the current view). With the fold panels 1130,1330 adhered to the bottom panel 1230 and intermediary panel 1430, respectively, the fold panels 1130, 1330 can be forced to move in concert with the panels 1230,1430, respectively. In the current aspect, the bottom panel 1230 can be seen arranged above the intermediary panel 1430.

Figure 5:
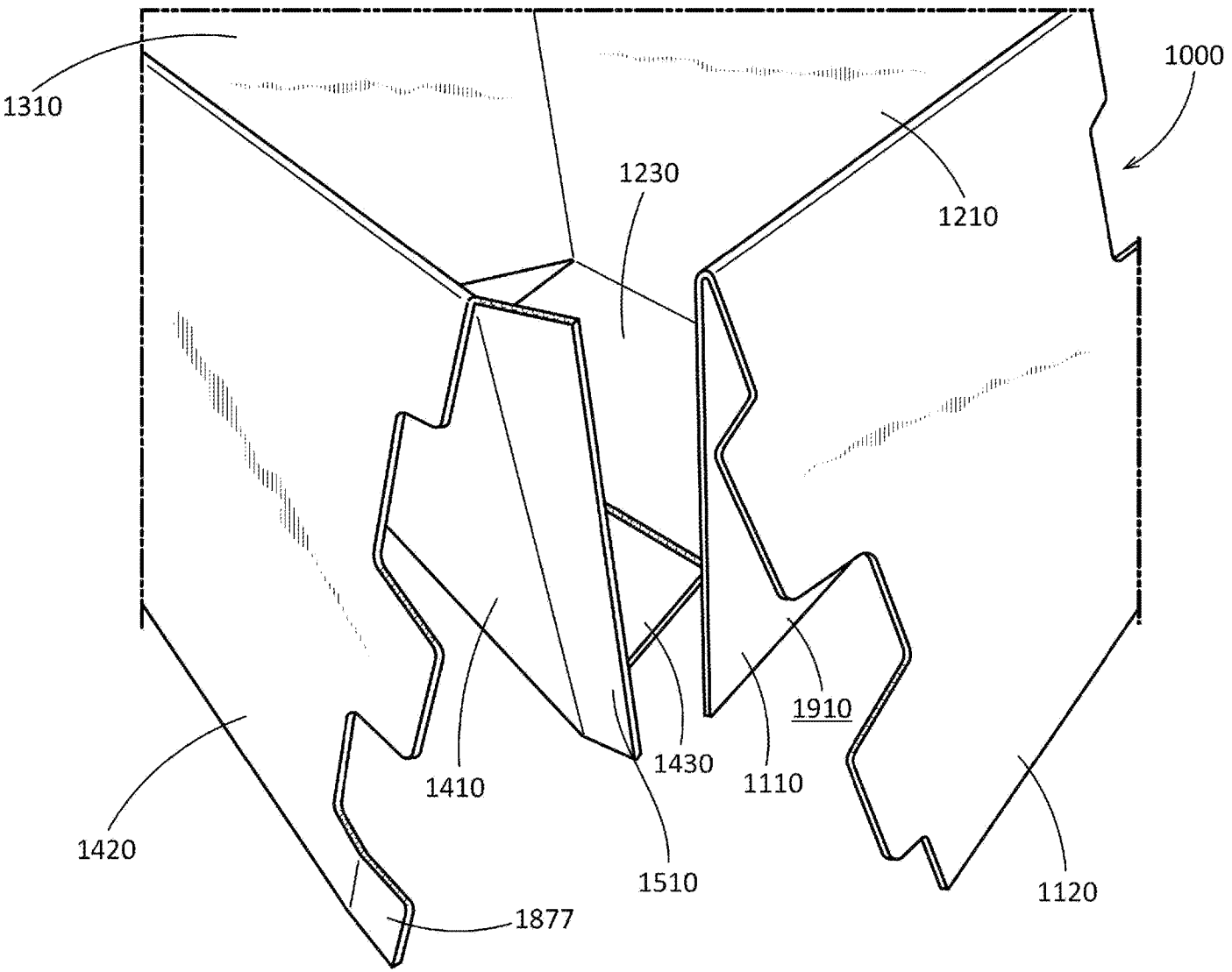
FIG. 5 is a side perspective view of the liner blank of FIG. 1 in another step of assembly into the liner.

Further folding of the liner blank 1000 can be seen with reference to FIG. 5. The connection panel 1510 can be arranged such that it can contact a surface of the first central panel 1110. In the current aspect, the connection panel 1510 can be arranged to contact and be adhered to an outer surface 1910 of the first central panel 1110. In various aspects, the connection panel 1510 can be adhered to an inner surface of the first central panel 1110, or to an inner or outer surface of the first end panel 1120. In various aspects, the connection panel 1510 can be arranged to connect to one or both of the first central panel 1110 and the first end panel 1120 through mechanical connection arrangements. In various aspects, adhesion or connection of the nature described here can be unnecessary. The connection protrusion 1877 can also be seen in the current view. The connection protrusion 1877 can allow connection to the first end panel 1120. In the current aspect, the connection protrusion 1877 can be adhered to an underside of the first end panel 1120. In various aspects, the connection protrusion 1877 can be adhered to the first central panel 1110 or to various sides of the first end panel 1120.

Figure 6:
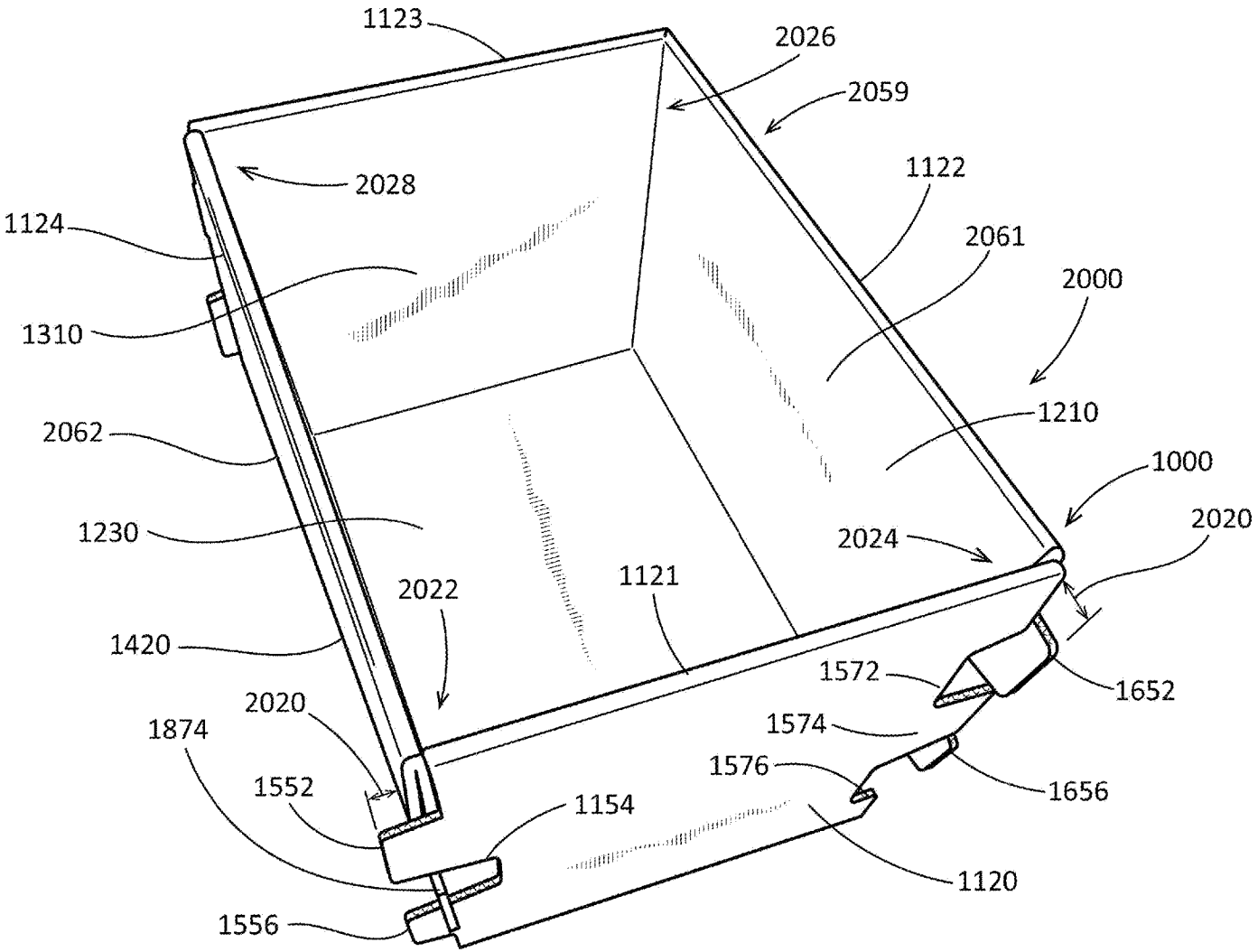
FIG. 6 is a top side perspective view of the liner formed from the liner blank of FIG. 1 in accord with one aspect of the current disclosure.
Figure 7:
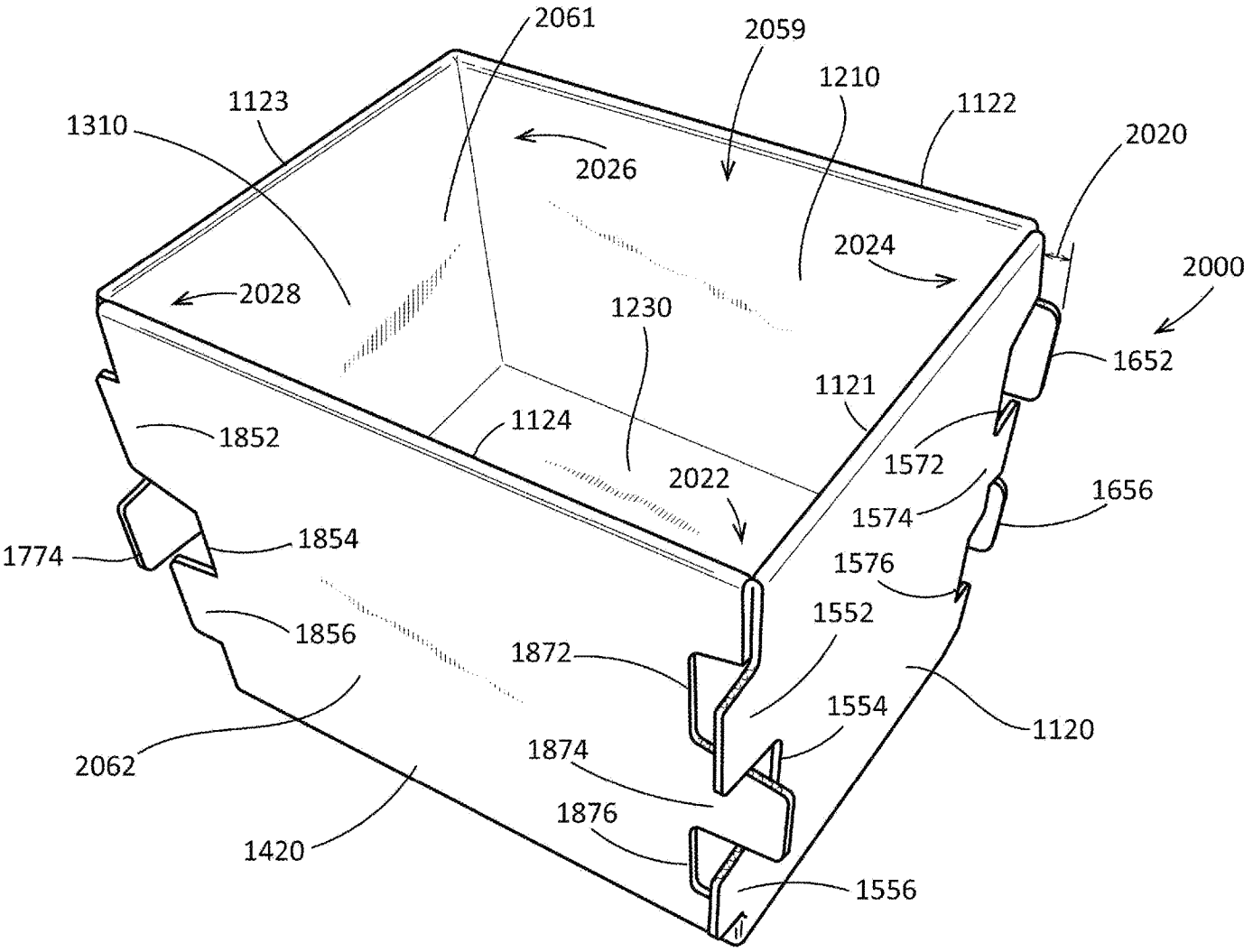
FIG. 7 is another top side perspective view of the liner of FIG. 6.

As seen with reference to FIGS. 6-7, a liner 2000 can be an end packaging element formed from the liner blank 1000. The liner 2000 can be rectangular in shape and can be designed to fit inside another packaging element. Interaction of the protrusions and recessions can be seen. The first recession 1872 can be arranged to make space for the first protrusion tab 1552 to extend beyond the fourth end panel 1420 by an insulation distance 2020. The second recession 1876 can be arranged to make space for the second protrusion tab 1576 to extend beyond the fourth end panel 1420 by the same insulation distance 2020. In the current aspect, interactions of protrusion tabs around the liner 2000 can extend beyond surfaces by the same distance. In various aspects, various protrusion tabs can be of various insulation distances. Similarly, the recession 1554 can be arranged to make space for the protrusion tab 1874 to extend beyond the first end panel 1120 by the same insulation distance 2020. In the current view, another corner of the liner 2000 can be seen. First protrusion tab 1652 can be arranged within first recession 1572 such that the first protrusion tab 1652 can extend beyond the first end panel 1120 by the insulation distance 2020. Second protrusion tab 1656 can be arranged within second recession 1576 such that the second protrusion tab 1656 can extend beyond the first end panel 1120 by the insulation distance 2020.

As seen, the protrusion tabs 1552, 1556, 1574, 1652, 1656, 1674, 1752, 1756, 1774, 1852, 1856, 1874 can become various separation features. For example, protrusion tabs 1552,1556 can combine to be termed one separation features, while protrusion tab 1574 can be termed its own separation feature. Various versions of separation features can be utilized as would be understood by one of skill in the art. Various arrangements of protrusion tabs 1552, 1556, 1574, 1652, 1656, 1674, 1752, 1756, 1774, 1852, 1856, 1874 can be made from various arrangement of features of various liners and liner blanks as would be understood by one of skill in the art.

Various corners 2022,2024,2026,2028 around the liner 2000 can be arranged similarly using the various protrusion tabs and recessions previously noted with reference to FIG. 1. As such, each corner 2022,2024,2026,2028 of the liner 2000 can define a support structure to isolate the end panels 1120,1220,1320,1420 from a packaging element into which the liner 2000 can be inserted. The liner 2000 can define an opening 2059 along a top end of the liner 2000. The liner 2000 can define an interior 2061 and an exterior 2062. The opening 2059 can be defined as the place in the liner 2000 that defines a transition between the interior 2061 and the exterior 2062. Without additional features, the opening 2059 can be defined by the lines 1121,1122,1123,1124. In various aspects, additional features can be utilized to define the opening 2059.

Figure 8:
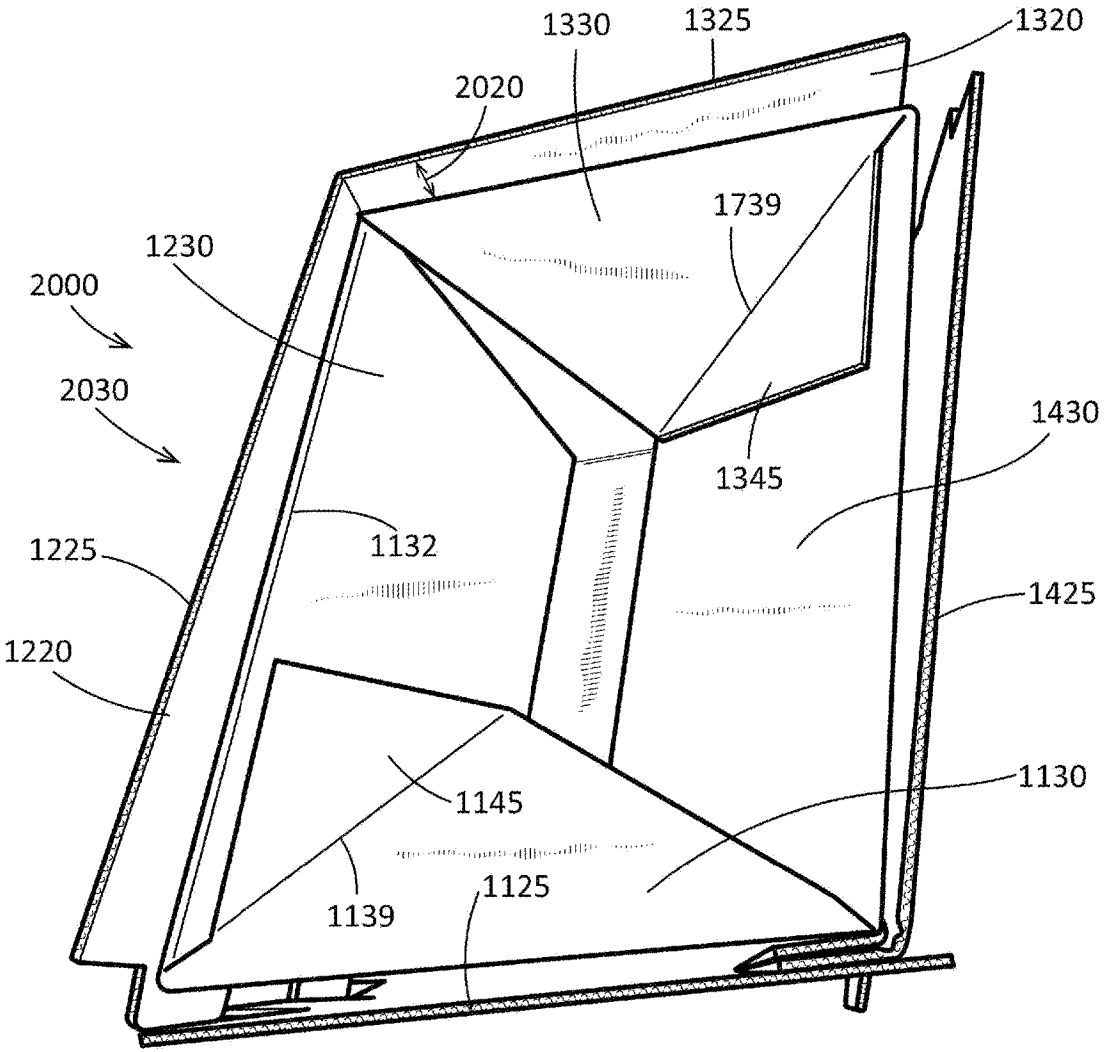
FIG. 8 is a bottom perspective view of the liner of FIG. 6.

A bottom 2030 of the liner 2000 can be seen with reference to FIG. 8. The bottom 2030 of the liner 2000 can comprise the fold panels 1130,1330, the bottom panel 1230, and the intermediary panel 1430 along with the panel ends 1125,1225,1325,1425 of the end panels 1120,1220,1320, 1420, respectively.

Figure 9:
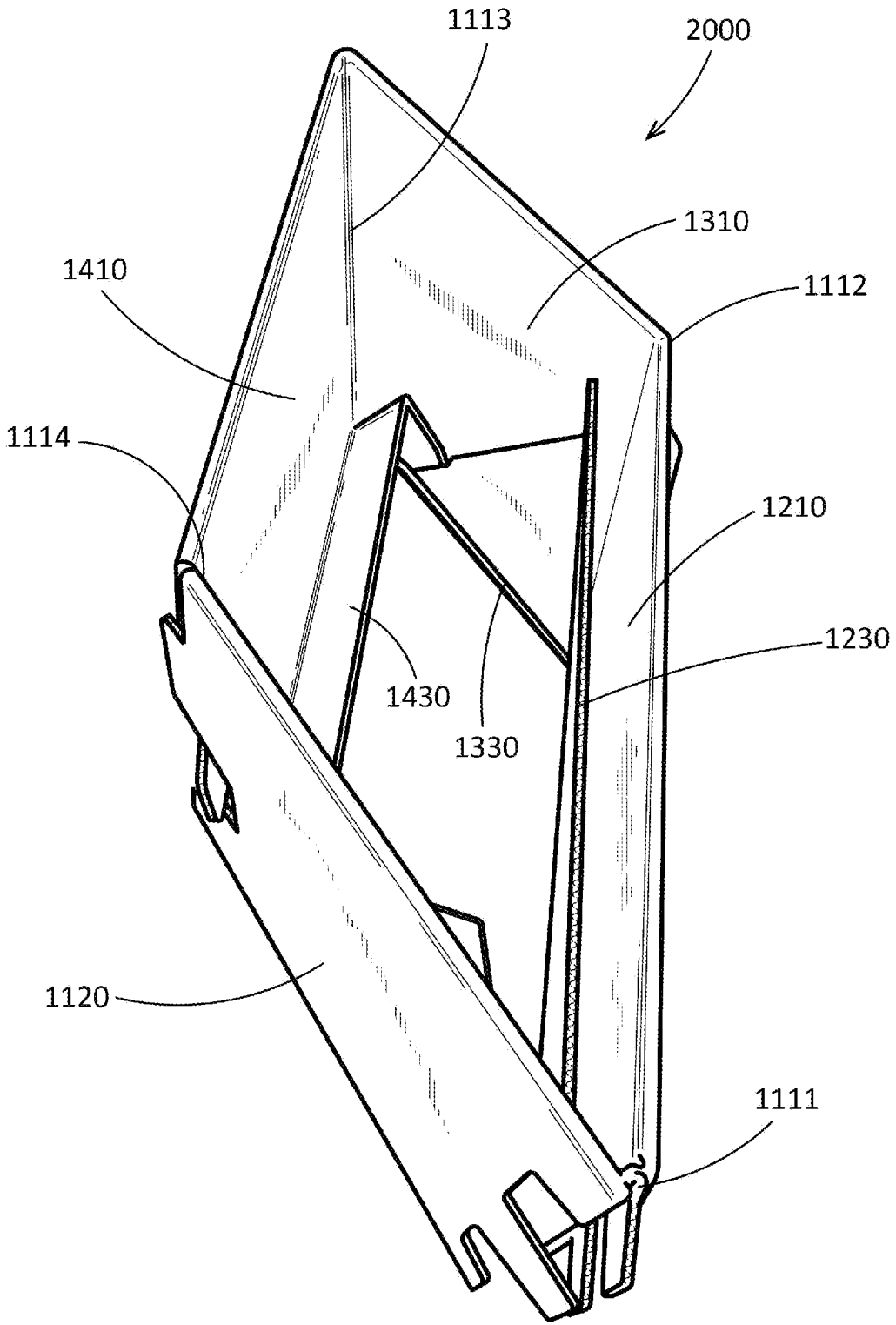
FIG. 9 is a top side perspective view of the liner of FIG. 6 in a collapsible arrangement in accord with one aspect of the current disclosure.

As can be seen, each end panel 1120,1220,1320,1420 can be sized slightly larger in a vertical direction than each central panel 1110,1210,1310,1410 to which it connects, respectively. The effect is that the panel ends 1125,1225, 1325,1425 can extend beyond surfaces of the panels 1130, 1230,1330,1430 comprising the bottom 2030 by a distance which, in the current aspect, can be the insulation distance 2020. As such the panels 1130,1230,1330,1430 comprising the bottom 2030 can be isolated from a bottom extent of the liner 2000. Such arrangement can thereby isolate the contents of the liner 2000 from any packaging element into which the liner 2000 can be placed. As seen with reference to FIG. 9, in various aspects the liner 2000 can be collapsible by folding the bottom panel 1430 and intermediary panel 1230 while bending the fold panels 1130,1330 along lines 1139,1739 and bending lines 1111,1112,1113,1114. As such, in various aspects, the liner 2000 can be collapsed to a smaller size for transport, packaging, or various other reasons.

Figure 10:
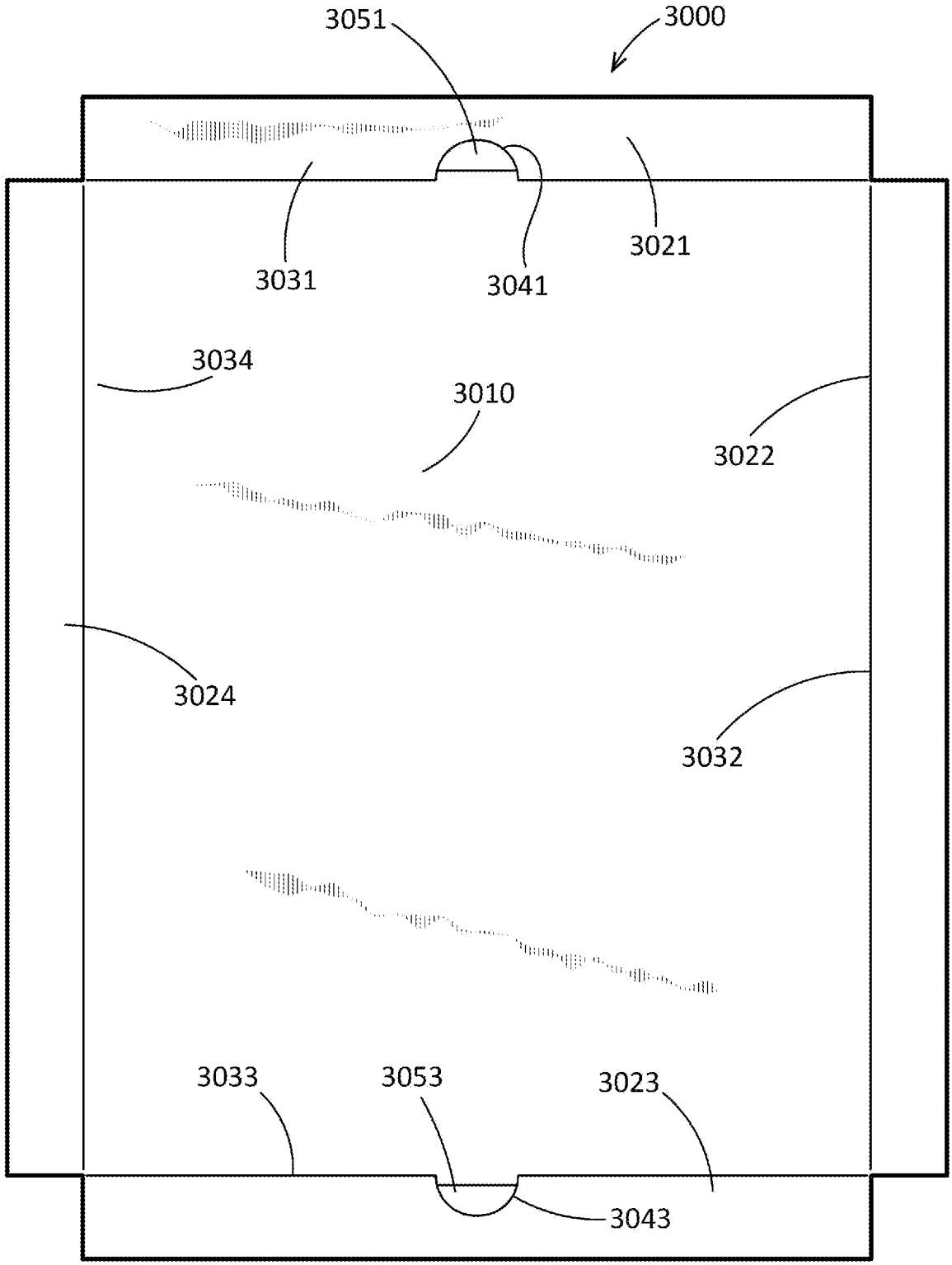
FIG. 10 is a plan view of a blank for forming a liner top in accord with one aspect of the current disclosure.
Figure 11:
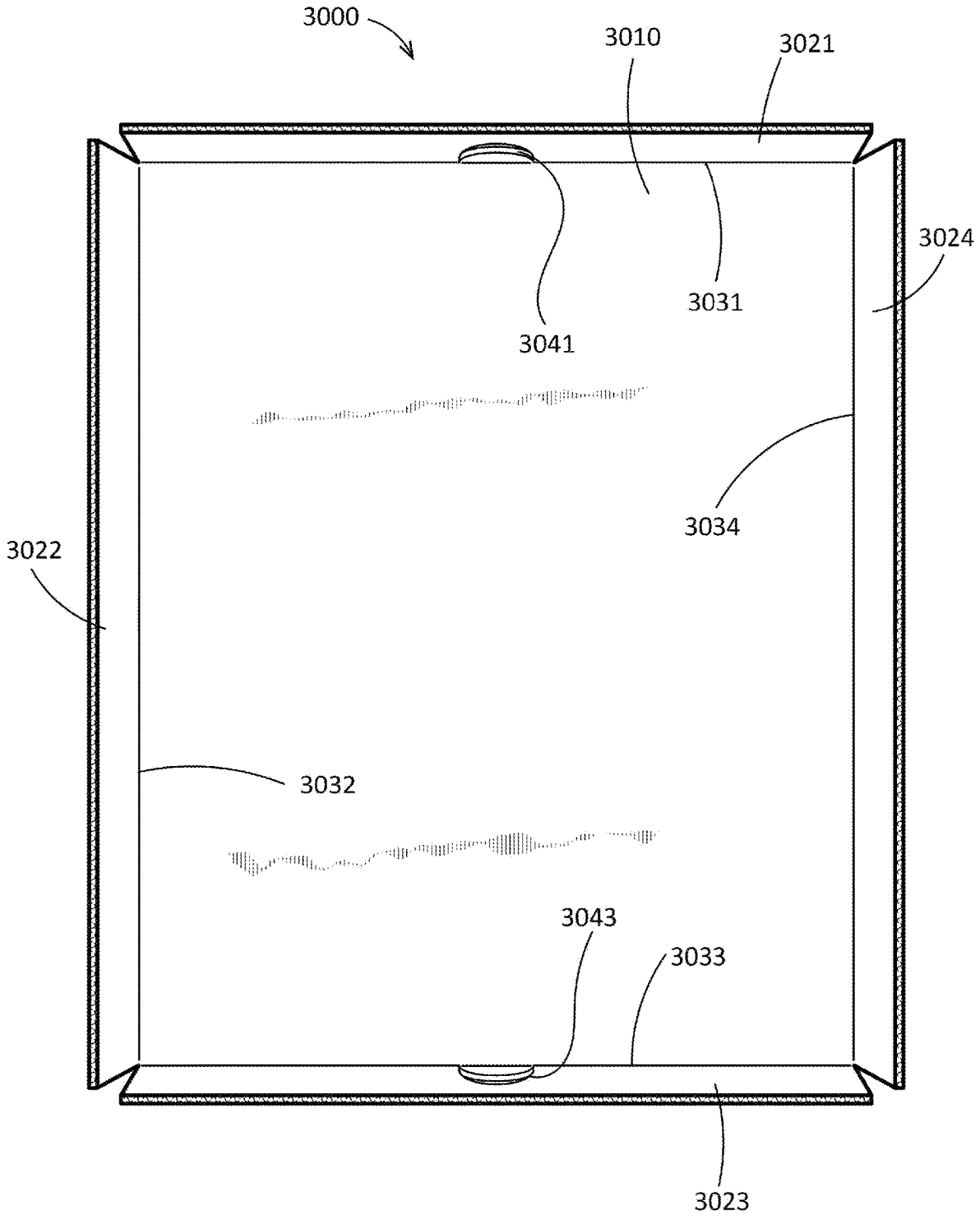
FIG. 11 is a top view of the liner top formed from the blank of FIG. 10.

A liner top 3000 can be seen with reference to FIGS. 10-11. The liner top 3000 can have main body 3010 being about rectangular in shape and sized to match an inside rectangular shape of the liner 2000. The liner top 3000 can define a first end tab 3021, a second end tab 3022, a third end tab 3023, and a fourth end tab 3024. The first end tab 3021 can be connected to the main body 3010 by a line 3031; the second end tab 3022 can be connected to the main body 3010 by a line 3032; the third end tab 3023 can be connected to the main body 3010 by a line 3033; the fourth end tab 3024 can be connected to the main body 3010 by a line 3034. The first end tab 3021 and the third end tab 3023 can define finger holes 3041,3043, respectively. Each finger hole 3041, 3043 can be formed by a punchout 3051,3053 that can be discarded. With specific reference to FIG. 11, each end tab 3021,3022,3023,3024 can be bent with respect to the main body 3010 along lines 3031,3032,3033,3034, respectively. As the liner top 3000 can be formed of cardboard, the shape memory of the cardboard can allow the end tabs 3021,3022, 3023,3024 to provide a natural spring force generally biasing the end tabs 3021,3022,3023,3024 toward an unbent position. The natural spring force can be used to suspend the liner top 3000 within the liner 2000 in assembly, as will be discussed in additional detail below.

In the current aspect, a surface of the liner top 3000 can be covered by a temperature-preserving liner. In various aspects, the temperature-preserving liner can be a product adhered to a surface of the liner top 3000. In various aspects, the temperature-preserving liner can be a film adhered to the surface of the liner top 3000. Films can be adhered to the surface of the liner top 3000 through various methods, including adhesion (such as with glues or chemical adhesives) or by deposition (such as by vapor deposition) among other methods. In various aspects, the film temperature-preserving liner can be a highly reflective coating. Such a highly reflective surface can be of low emissivity, thereby serving as an effective insulating material. Examples of coatings or films that can be used for temperature-preserving liners can be found with reference to United States Patent Application of Sollie, filed Jul. 14, 2023, bearing application Ser. No. 18/222,272, which is incorporated by reference herein in its entirety. In various aspects, the liner top 3000 can include the temperature-preserving liner on all sides. In various aspects, the liner top 3000 can include the temperature-preserving liner on only one side to reduce costs. In such arrangements, the temperature-preserving line can be arranged on a side of the liner top 3000 that can be oriented toward an inside of the packaging element formed by the liner 2000 and the liner top 3000.

Figure 12:
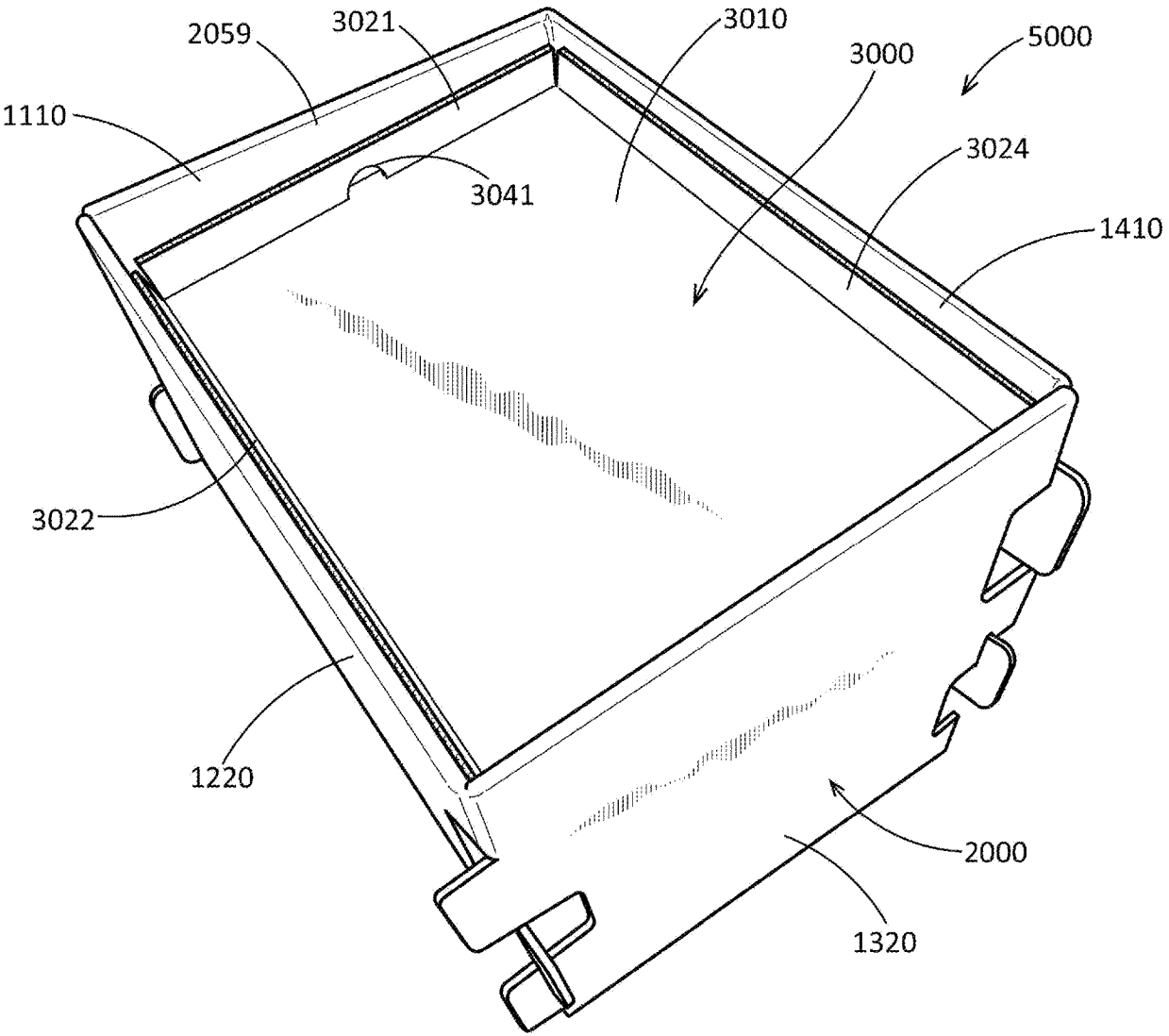
FIG. 12 is a top perspective view of a liner subassembly comprising the liner of FIG. 6 and the liner top of FIG. 10 in accord with one aspect of the current disclosure.

As can be seen with reference to FIG. 12, the liner top 3000 can be arranged inside the liner 2000. The first end tab 3021 can contact the first central panel 1110; the second end tab 3022 can contact the second central panel 1210; the third end tab 3023 can contact the third central panel 1310; the fourth end tab 3024 can contact the fourth central panel 1410. As such, the liner top 3000 can be suspended within the opening 2059 by the spring force exerted by the cardboard shape memory of the end tabs 3021,3022,3023,3024. As such, the liner top 3000 can be arranged within the opening 2059 of the liner 2000 in a variety of arrangements. If the liner 2000 contains an amount of contents, the liner top 3000 can be adjusted in its depth within the opening 2059 to match the size of the contents. Together, the liner 2000 and liner top 3000 can be a liner subassembly 5000.

Figure 13:
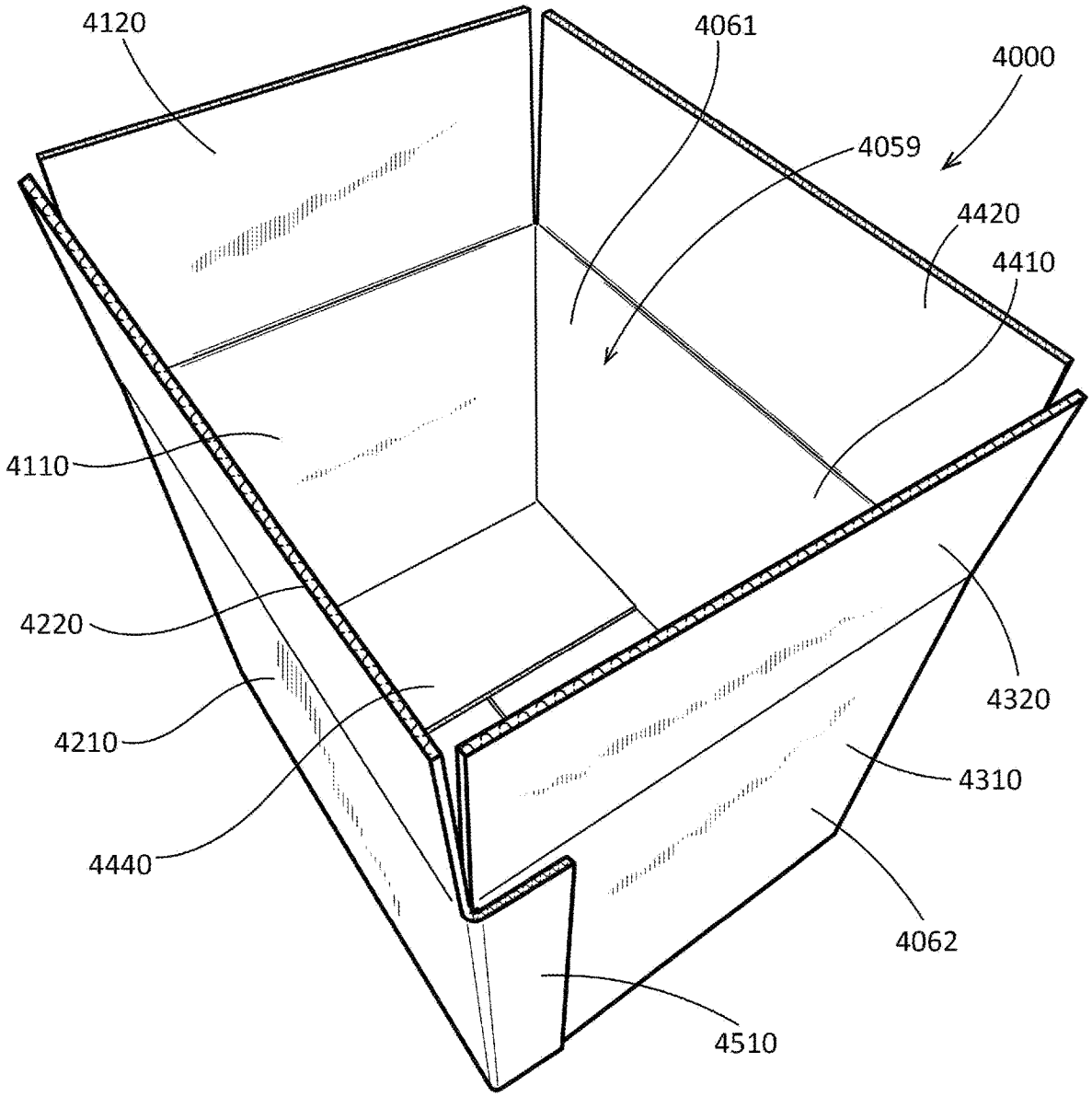
FIG. 13 is a top perspective view of a box for use with the liner subassembly of FIG. 12 to form an insulated packaging assembly in accord with one aspect of the current disclosure.
Figure 14:
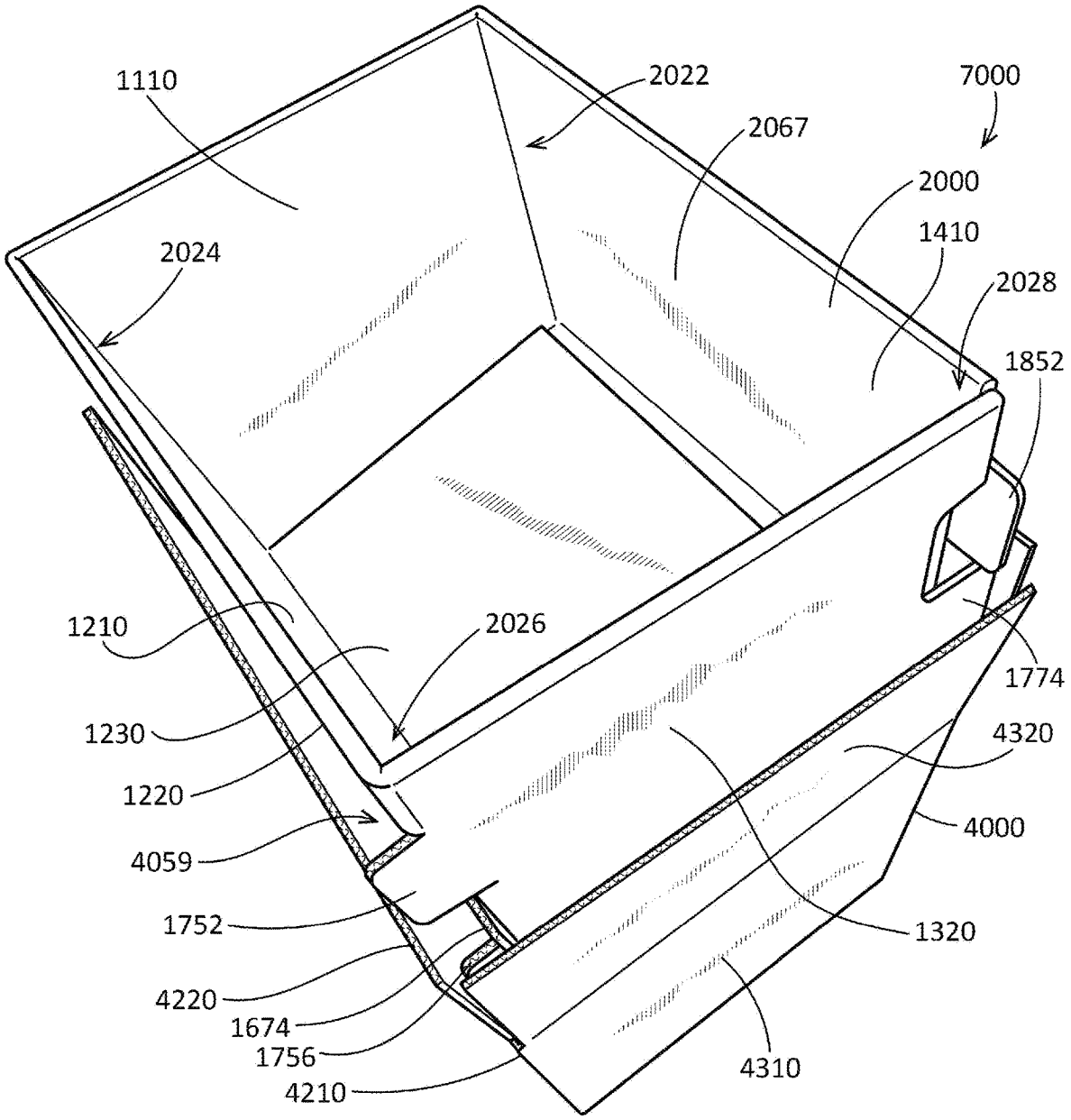
FIG. 14 is a top perspective view of an assembly step for forming the insulated packaging assembly, the step comprising placing the liner of FIG. 6 into the box of FIG. 13.

A standard box 4000 can be seen with reference to FIG. 13. The box 4000 can comprise a first side 4110, a second side 4210, a third side 4310, and a fourth side 4410. The box 4000 can comprise a bottom 4440. In various aspects, the bottom 4440 can be a plurality of panels arranged together as would be known by one of skill in the art. A connection panel 4510 can extend from the first side 4210 and can be seen adhered to the third side 4310. A first top 4120 can be connected to the first side 4110. A second top 4220 can be connected to the second side 4210. A third top 4320 can be connected to the third side 4310. A fourth top 4420 can be connected to the fourth side 4410. In various aspects, each connection between one side 4110,4210,4310,4410 and one top 4120,4220,4320,4420 can be a bend line. The box 4000 can define an opening 4059 and thereby define an interior 4061 and an exterior 4062.

An insulated packaging assembly 7000 can be seen with reference to FIGS. 14-17. The liner 2000 can be inserted into the box 4000. The box 4000 can be sized to accept the liner 2000 in its opening 4059. With specific reference to FIG. 14, the liner 2000 can be arranged such that protrusions 1752, 1756 contact the second top 4220, the protrusions 1674, 1852, and 1856 (not shown in the current view) contact the third top 4320, and the protrusion 1774 contacts the fourth top 4420 (not shown in the current view). Similar arrangement can be made on the other side and with respect to all the corners 2022,2024,2026,2028 of the liner 2000.

Figure 15:
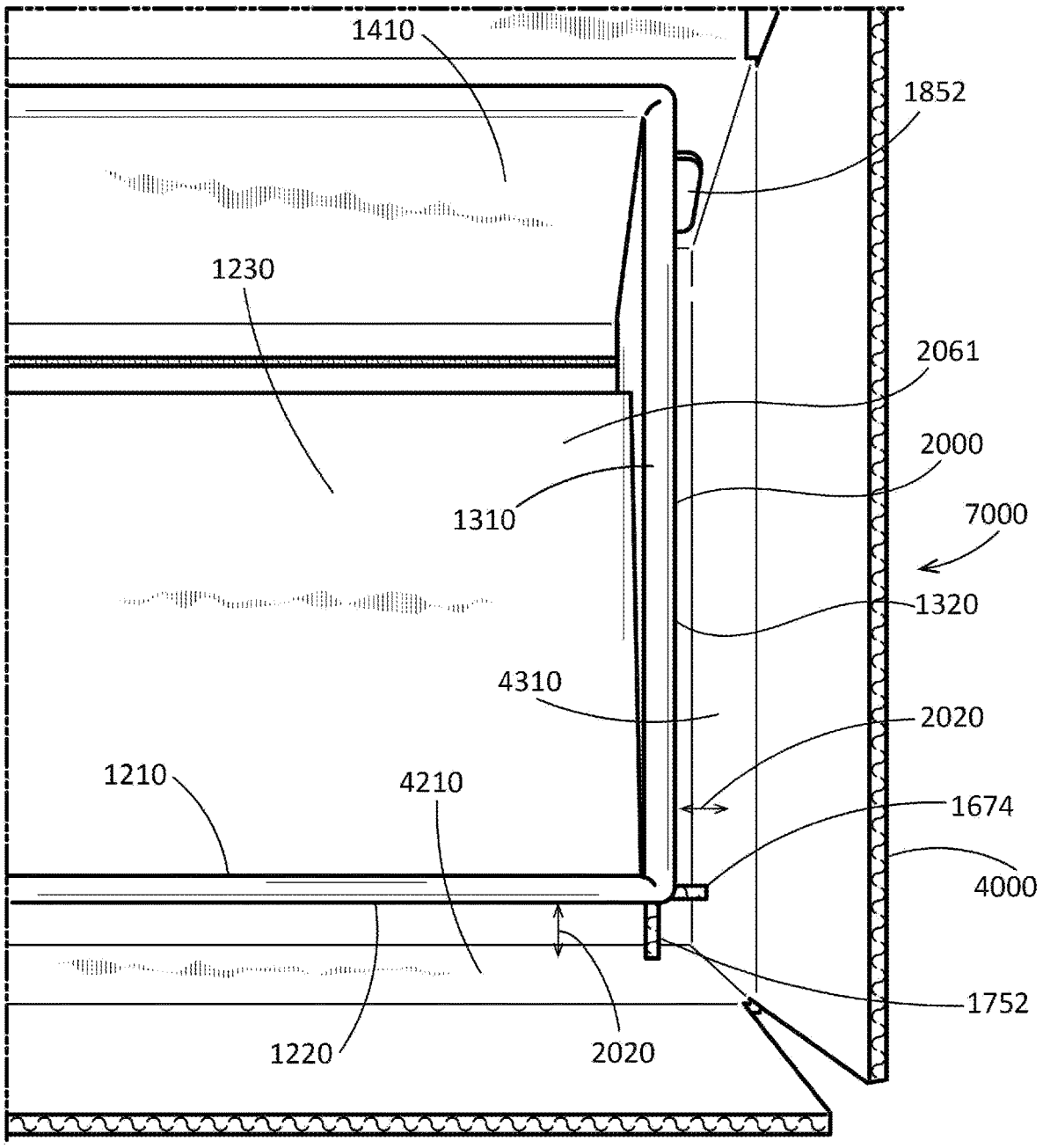
FIG. 15 is a top detail view of the insulated packaging assembly of FIG. 14.
Figure 16:
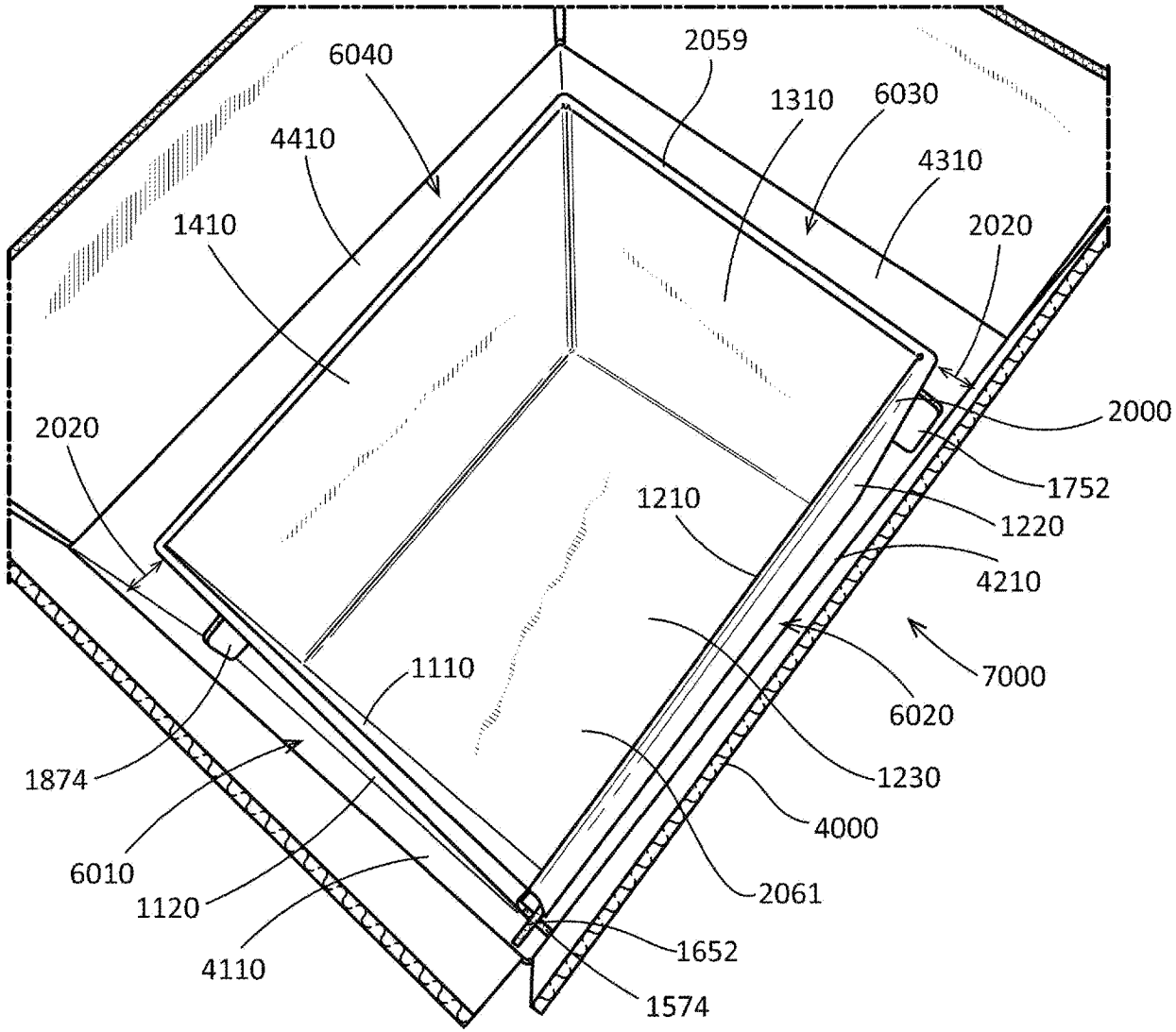
FIG. 16 is a top perspective view of the insulated packaging assembly of FIG. 14.

The insulated packaging assembly 7000 can be seen with the liner 2000 in place in the box 4000 in the view of FIGS. 15-16. With specific reference to FIG. 15, the protrusion tabs 1852,1674 can be seen maintaining separation between the third end panel 1320 of the liner 2000 and the third side 4310 of the box 4000. Similarly, the protrusion tab 1752 can be seen as partly maintaining separation between the second end panel 1220 of the liner 2000 and the second side 4210 of the box 4000. With reference to FIG. 16, the protrusion tabs 1652,1874 can be seen maintaining the insulation distance 2020 between the first side 4110 of the box 4000 and the first end panel 1120 of the liner 2000. Similarly, protrusions 1574,1752 can be seen maintaining the insulation distance 2020 between the second side wall 4210 of the box 4000 and the second end panel 1220 of the liner 2000. Although specific protrusions are called out in the current views, one of skill in the art would understand that additional protrusions can be contacting side walls 4110,4210, 4310,4410 to maintain distances around the liner 2000. Gaps 6010,6020,6030,6040 (shown in FIG. 16) can be defined between the liner 2000 and the box 4000.

Figure 17:
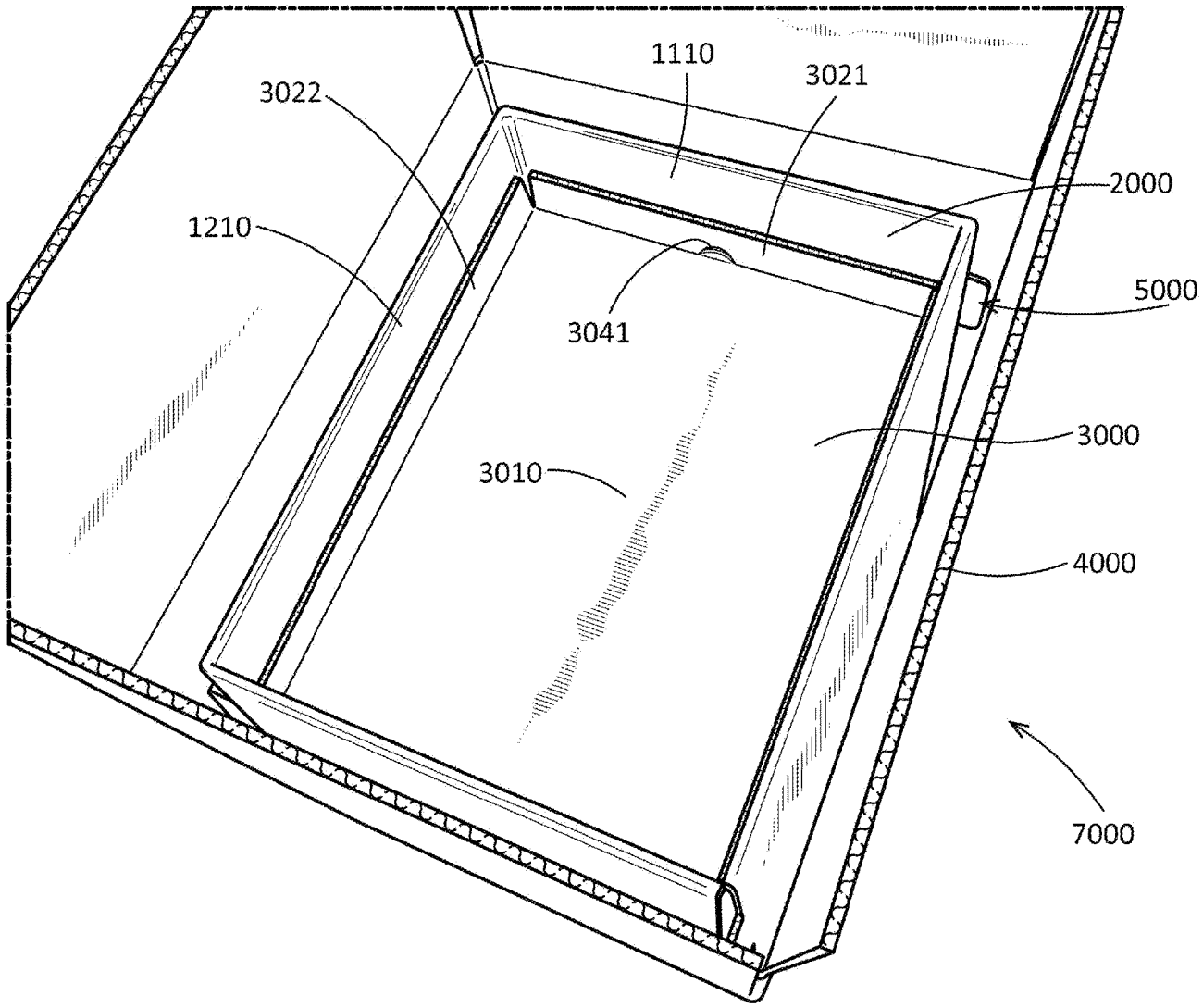
FIG. 17 is a top perspective view of the insulated packaging assembly of FIG. 14 including the liner top of FIG. 11 in accord with one aspect of the current disclosure.

As would be understood by one of skill in the art, the insulated packaging assembly 7000 can function as an efficient system to isolate contents within the system. By maintaining an insulation distance 2020 in various locations around the contents within the interior 2061 can be thermally isolated from surroundings. The gaps 6010,6020, 6030,6040 provide a thermal insulation because air located in the gaps 6010,6020,6030,6040 is a poor thermal conductor. As previously noted, temperature-preserving liner applied to the surface of the liner 2000 can isolate the contents from radiative heat transfer. When the box 4000 is closed and sealed, air movement within the box 4000 can be minimized thereby reducing convective heat transfer as well. Because of the method of folding of the liner blank 1000 into liner 2000, contents within the liner 2000 can be surrounded by at least two ply cardboard in all directions of the liner when the liner 2000 is formed of cardboard. In the current aspect, the only direction that can have less than two-ply cardboard can be the top of the liner 2000, where the opening 2059 can be located. With reference to FIG. 17, the liner top 3000 can be placed in liner 2000 as part of the insulated packaging assembly 7000. As such, the liner top 3000 can form the top of the liner subassembly 5000 that can provide the first layer of insulation around any contents within the insulated packaging assembly 7000. When the box 4000 can be closed around the liner 2000 with the liner top 3000 in place, any contents of the insulated packaging assembly 7000 can be thermally isolated from any environmental factors.

Because the insulated packaging assembly 7000 can be formed of cardboard—generally from blanks such as liner blank 1000—the end product can be simple to produce and contain few parts. Additionally, the product can be generally recyclable as a bulk paper product. Finally, the insulated packaging assembly 7000 can be an effective insulating packaging solution for low cost as compared to other packaging solutions.

Figure 18:
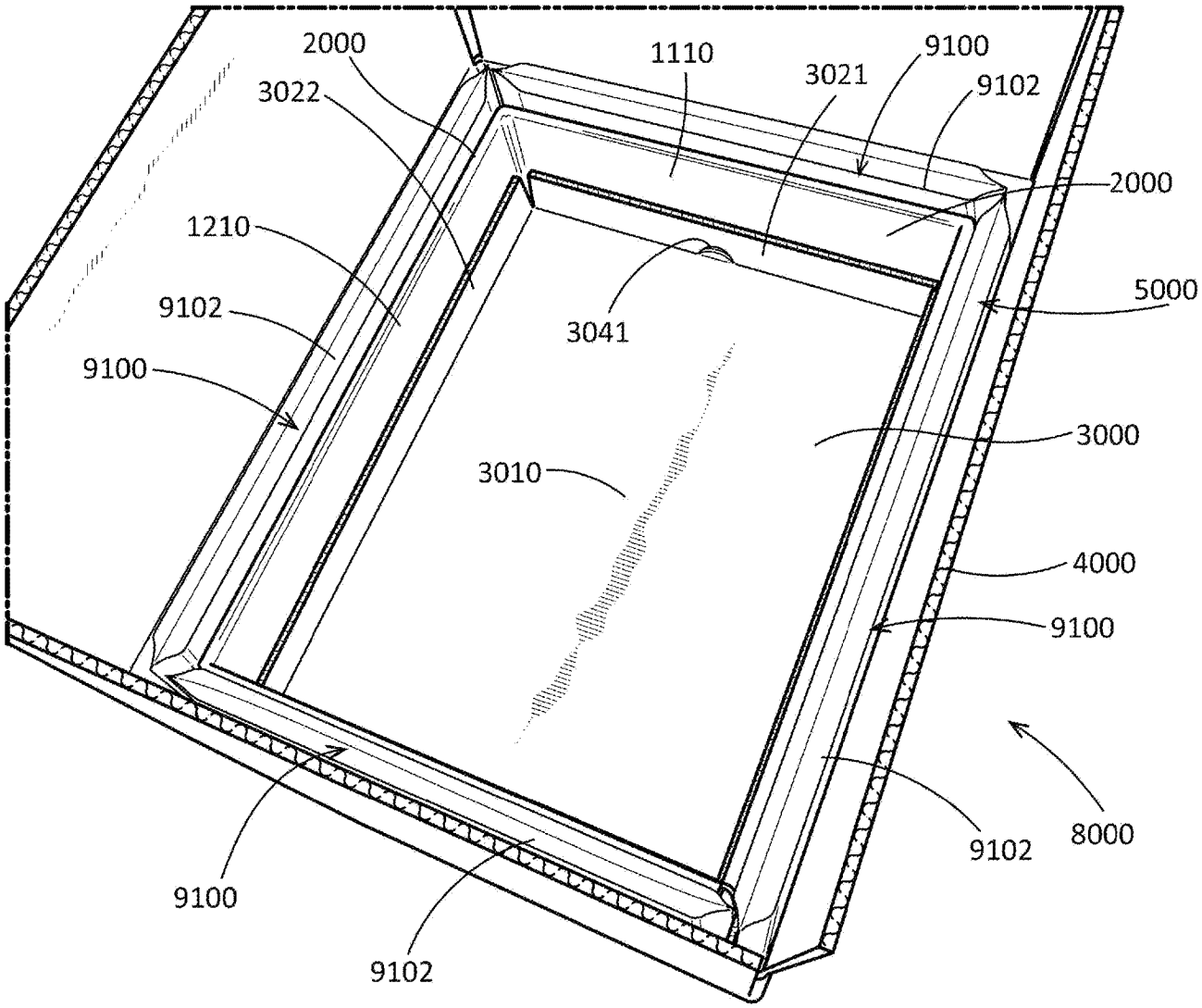
FIG. 18 is a top perspective view of the insulated packaging assembly of FIG. 14 including the liner top of FIG. 11 and with added insulator in accord with one aspect of the current disclosure.

Another aspect of an insulated packaging assembly 8000 can be seen with reference to FIG. 18. In the current aspect, the insulated packaging assembly 8000 can comprise similar features to the insulated packaging assembly 7000. The insulated packaging assembly 8000 can also comprise at least one insulator 9100. In the current aspect, four insulators 9100 can be utilized. In various aspects, one insulator 9100 can be used and can be fit around the liner subassembly 5000 within the box 4000. In such aspect, the insulator 9100 can be cut or compressed in regions of the liner 2000 that have protrusion tabs 1552, 1556, 1574, 1652, 1656, 1674, 1752, 1756, 1774, 1852, 1856, 1874. In various aspects, two, three, or more insulators 9100 of varying shapes and sizes can be utilized to perform similar function to the insulators 9100 shown and described.

Each insulator can be a physical object of insulting capacity such as an insulating pad, an air-filled bag, added cardboard, added paper product, paper fill, or various other insulation. In the current aspect, each insulator 9100 can be an insulation batt encapsulated within a paper capsule 9102. The paper capsule 9102 can be a first paper layer secured to a second paper layer and sealed around a perimeter of the insulation batt to encapsulate the insulation batt. In various aspects, the insulation batt can be repulpable. Further description of aspects of some insulators 9100 that can be used in the packaging assembly 8000 can be found with reference to the following United States Patents and Applications for United States Patent, which are incorporated by reference herein in their entirety: U.S. patent application Ser. No. 17/834,999, filed Jun. 8, 2022, (issued as U.S. Pat. No. 11,780,666 on Oct. 10, 2023); U.S. patent application Ser. No. 17/502,599, filed Oct. 15, 2021 (issued as U.S. Pat. No. 11,634,265 on Apr. 25, 2023); U.S. patent application Ser. No. 17/123,673, filed Dec. 16, 2020 (issued as U.S. Pat. No. 11,214,427 on Jan. 4, 2022); U.S. patent application Ser. No. 16/414,309, filed May 16, 2019 (issued as U.S. Pat. No. 10,882,682 on Jan. 5, 2021); U.S. patent application Ser. No. 15/677,738, filed Aug. 15, 2017 (issued as U.S. Pat. No. 10,583,977 on Mar. 10, 2020); U.S. Provisional Application No. 62/375,555, filed on Aug. 16, 2016; U.S. Provisional Application No. 62/419,894, filed on Nov. 9, 2016; and, U.S. Provisional Application No. 62/437,365, filed on Dec. 21, 2016.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. An insulated packaging assembly comprising:

a box, the box having a plurality of sides and a bottom, the box defining an opening at a top end;

a liner, the liner comprising a plurality of sides, each side of the liner being defined by an end panel having a pair of ends and corresponding to one side of the box such that the box and the liner comprise the same number of sides;

a bottom; and at least one separation feature connected to each side of the liner, wherein each separation feature is arranged between the side of the liner and the corresponding side of the box such that the side of the liner is arranged an insulation distance from the corresponding side of the box; and a liner top, the liner top being in contact with each of the plurality of sides of the liner;

wherein each end of each end panel defines a first protrusion tab and a first recession, and a first separation feature of the at least one separation feature connected to each side of the liner comprises the first protrusion tab of one of the end panels being arranged in the first recession of an adjacent end panel so that the first protrusion of the one of the end panels extends beyond an outer surface of the adjacent end panel.

2. A liner blank comprising:

a first central panel connected to a second central panel by a line;

a third central panel connected to the second central panel by a line;

a fourth central panel connected to the third central panel by a line;

a first end panel connected to the first central panel by a line, the first end panel defining a first end, the first end defining a first protrusion tab, a second protrusion tab, and a recession defined between the first protrusion tab and the second protrusion tab;

a second end defining a first recession, a second recession, and a protrusion tab defined between the first recession and the second recession; and a panel end;

a second end panel connected to the second central panel by a line, the second end panel defining a first end of the second end panel, the first end of the second end panel being coincident with the second end of the first end panel, the first end of the second end panel defining a first protrusion tab, a second protrusion tab, and a recession defined between the first protrusion tab and the second protrusion tab;

a second end of the second end panel defining a first recession, a second recession, and a protrusion tab defined between the first recession and the second recession; and a panel end of the second end panel;

a third end panel connected to the third central panel by a line, the third end panel defining a first end of the third end panel, the first end of the third end panel being coincident with the second end of the second end panel, the first end of the third end panel defining a first protrusion tab, a second protrusion tab, and a recession defined between the first protrusion tab and the second protrusion tab;

a second end of the third end panel defining a first recession, a second recession, and a protrusion tab defined between the first recession and the second recession; and a panel end of the third end panel;

a fourth end panel connected to the fourth central panel by a line, the fourth end panel defining a first end of the fourth end panel, the first end of the fourth end panel being coincident with the second end of the third end panel, the first end of the fourth end panel defining a first protrusion tab, a second protrusion tab, and a recession defined between the first protrusion tab and the second protrusion tab;

a second end of the fourth end panel defining a first recession, a second recession, and a protrusion tab defined between the first recession and the second recession; and a panel end of the fourth end panel.

3. The liner blank of claim 2, wherein each protrusion tab is filleted.

4. The liner blank of claim 3, wherein at least one protrusion tab laterally extends each end and wherein at least one recession laterally contracts each end.

5. The liner blank of claim 3, wherein each recession is filleted.

6. The liner blank of claim 3, wherein at least one surface of the liner blank is covered in temperature-preserving film.

7. The liner blank of claim 2 further comprising:

a first fold panel connected to the first central panel by a line;

a bottom panel connected to the second central panel by a line;

a second fold panel connected to the third central panel by a line; and an intermediary panel connected to the fourth central panel by a line.

8. The liner blank of claim 7 further comprising a connection panel connected to the fourth central panel by a line.

9. The liner blank of claim 8 further comprising a connection protrusion extending from the second end of the fourth end panel proximate the panel end of the fourth end panel.

10. The liner blank of claim 8, wherein each panel end is aligned.

11. The liner blank of claim 8, wherein each fold panel comprises:

a main base panel; and a connection panel connected to the main base panel by a line.

12. The liner blank of claim 11, wherein each main base panel and each connection panel is triangular in shape.

13. An insulated packaging assembly comprising:

a box, the box comprising a first side having an inner surface;

a second side connected to an end of the first side, the second side having an inner surface;

a third side connected to an end of the second side, the third side having an inner surface;

a fourth side connected to an end of the third side and another end of the first side, the fourth side having an inner surface; and a bottom connected to an end of each side, the bottom having an inner surface;

a liner formed from a blank, the liner comprising:

a first central panel connected to a second central panel at an end of each panel;

a third central panel connected to the second central panel at an end of each panel;

a fourth central panel connected to the third central panel at an end of each panel, the fourth central panel connected to the first central panel to form a rectangular lining;

a first end panel contacting the first central panel in facing arrangement, the first panel end defining a first end, the first end defining a first protrusion tab, a second protrusion tab, and an alternate recession defined between the first protrusion tab and the second protrusion tab;

a second end defining a first recession, a second recession, and an alternate protrusion tab defined between the first recession and the second recession;

a panel end; and an outer surface;

a second end panel contacting the second central panel in facing arrangement, the second end panel defining a first end of the second end panel defining a first protrusion tab, a second protrusion tab, and an alternate recession defined between the first protrusion tab and the second protrusion tab;

a second end of the second end panel defining a first recession, a second recession, and an alternate protrusion tab defined between the first recession and the second recession;

a panel end of the second end panel; and an outer surface of the second end panel;

a third end panel contacting the third central panel in facing arrangement, the third end panel defining a first end of the third end panel defining a first protrusion tab, a second protrusion tab, and an alternate recession defined between the first protrusion tab and the second protrusion tab;

a second end of the third end panel defining a first recession, a second recession, and an alternate protrusion tab defined between the first recession and the second recession;

a panel end of the third end panel; and an outer surface of the third end panel;

a fourth end panel contacting the fourth central panel in facing arrangement, the fourth end panel defining a first end of the fourth end panel defining a first protrusion tab, a second protrusion tab, and an alternate recession defined between the first protrusion tab and the second protrusion tab;

a second end of the fourth end panel defining a first recession, a second recession, and an alternate protrusion tab defined between the first recession and the second recession;

a panel end of the fourth end panel; and an outer surface of the fourth end panel;

wherein the alternate protrusion tab of the first end panel is arranged within the alternate recession of the second end panel such that the alternate protrusion tab of the first end panel extends beyond the outer surface of the second end panel;

the first protrusion tab of the second end panel is arranged within the first recession of the first end panel and the second protrusion tab of the second end panel is arranged within the second recession of the first end panel such that each of the first protrusion tab and second protrusion tab of the second end panel extends beyond the outer surface of the first end panel;

the alternate protrusion tab of the second end panel is arranged within the alternate recession of the third end panel such that the alternate protrusion tab of the second end panel extends beyond the outer surface of the third end panel;

the first protrusion tab of the third end panel is arranged within the first recession of the second end panel and the second protrusion tab of the third end panel is arranged within the second recession of the second end panel such that each of the first protrusion tab and second protrusion tab of the third end panel extends beyond the outer surface of the second end panel;

the alternate protrusion tab of the third end panel is arranged within the alternate recession of the fourth end panel such that the alternate protrusion tab of the third end panel extends beyond the outer surface of the fourth end panel;

the first protrusion tab of the fourth end panel is arranged within the first recession of the third end panel and the second protrusion tab of the fourth end panel is arranged within the second recession of the third end panel such that each of the first protrusion tab and second protrusion tab of the fourth end panel extends beyond the outer surface of the third end panel;

the alternate protrusion tab of the fourth end panel is arranged within the alternate recession of the first end panel such that the alternate protrusion tab of the fourth end panel extends beyond the outer surface of the first end panel;

the first protrusion tab of the first end panel is arranged within the first recession of the fourth end panel and the second protrusion tab of the first end panel is arranged within the second recession of the fourth end panel such that each of the first protrusion tab and second protrusion tab of the first end panel extends beyond the outer surface of the fourth end panel;

wherein the first protrusion tab of the second end panel, the second protrusion tab of the second end panel, and the alternate protrusion tab of the fourth end panel each contact the inner surface of the first side of the box such that the first end panel is separated from the first side of the box by an insulation distance;

the first protrusion tab of the third end panel; the second protrusion tab of the third end panel, and the alternate protrusion tab of the first end panel contact the inner surface of the second side of the box such that the second end panel is separated from the second side of the box by the insulation distance;

the first protrusion tab of the fourth end panel; the second protrusion tab of the fourth end panel, and the alternate protrusion tab of the second end panel contact the inner surface of the third side of the box such that the third end panel is separated from the third side of the box by the insulation distance; and, the first protrusion tab of the first end panel; the second protrusion tab of the first end panel, and the alternate protrusion tab of the third end panel contact the inner surface of the fourth side of the box such that the fourth end panel is separated from the fourth side of the box by the insulation distance.

14. The insulated packaging assembly of claim 13, wherein each protrusion tab is filleted.

15. The insulated packaging assembly of claim 14, wherein the box is formed of corrugated cardboard and wherein the liner is formed of corrugated cardboard.

16. The insulated packaging assembly of claim 15, wherein at least one surface of the liner is covered in temperature-preserving film.

17. The insulated packaging assembly of claim 16, further comprising a liner top contacting the liner.

18. The insulated packaging assembly of claim 17, wherein the liner top comprises a main body, a first end tab connected to the main body, a second end tab connected to the main body, a third end tab connected to the main body, and a fourth end tab connected to the main body, wherein the first end tab contacts the first central panel, the second end tab contacts the second central panel, the third end tab contacts the third central panel, and the fourth end tab contacts the fourth central panel.

19. The insulated packaging assembly of claim 18, wherein each end tab is connected to the main body of the liner top by a bend line, wherein each end tab is bent with respect to the main body along one bend line, wherein each bend retains spring force; wherein each end tab is maintains contact with one side of the box by friction.

* * * * *